US011563289B2

(12) United States Patent
Chen et al.

(10) Patent No.: US 11,563,289 B2
(45) Date of Patent: Jan. 24, 2023

(54) ELECTRICAL CONNECTION DEVICE AND TERMINAL

(71) Applicant: Molex, LLC, Lisle, IL (US)

(72) Inventors: Zhi-Dong Chen, Shanghai (CN); You-Xiang Zheng, Shanghai (CN)

(73) Assignee: Molex, LLC, Lisle, IL (US)

( * ) Notice: Subject to any disclaimer, the term of this patent is extended or adjusted under 35 U.S.C. 154(b) by 59 days.

(21) Appl. No.: 17/207,770

(22) Filed: Mar. 22, 2021

(65) Prior Publication Data

US 2021/0305751 A1 Sep. 30, 2021

(30) Foreign Application Priority Data

Mar. 26, 2020 (CN) ..... 202010222396.X

(51) Int. Cl.
*H01R 13/64* (2006.01)
*H01R 13/639* (2006.01)
(Continued)

(52) U.S. Cl.
CPC ..... *H01R 13/64* (2013.01); *H01R 12/51* (2013.01); *H01R 13/40* (2013.01); *H01R 13/516* (2013.01);
(Continued)

(58) Field of Classification Search
CPC ..... H01R 13/64; H01R 12/51; H01R 13/40; H01R 12/716
See application file for complete search history.

(56) References Cited

U.S. PATENT DOCUMENTS 3,264,599 A * 8/1966 Kinkaid ..... H01R 12/724 439/736
3,795,883 A * 3/1974 Ackerman ..... H01R 27/00 439/106
(Continued)

FOREIGN PATENT DOCUMENTS

CN 202454786 U 9/2012
JP 3055808 U 1/1999
(Continued)

OTHER PUBLICATIONS

Office Action received for JP Application No. 2021-052637, dated Feb. 8, 2022, 13 Pages (07 Pages of English translation and 06 Pages of Official notification).

*Primary Examiner* — Neil Abrams

(57) ABSTRACT

An electrical connection device includes a first connector and a second connector. The first connector includes an insulative body and a plurality of first terminals provided to the insulative body, the insulative body has an insertion groove, a first insertion opening which is communicated with the insertion groove and toward a first direction, a second insertion opening which is communicated with the insertion groove and toward a second direction and a stopping block which is positioned between the first insertion opening and the second insertion opening, the stopping block has a first stopping face which faces the first direction and a second stopping face which faces the second direction. The second connector includes an insulative housing and a plurality of second terminals provided to the insulative housing, the insulative housing has a mating portion and a contacting surface, when the second connector is mated with the first connector along the first direction, the mating portion is inserted into the insertion groove from the first insertion opening, and the contacting surface is stopped by the first stopping face of the stopping block, when the
(Continued)

second connector is mated with the first connector along the second direction, the mating portion is inserted into the insertion groove from the second insertion opening, and the contacting surface is stopped by the second stopping face of the stopping block.

11 Claims, 16 Drawing Sheets

(51) Int. Cl.
*H01R 12/51* (2011.01)
*H01R 13/516* (2006.01)
*H01R 13/629* (2006.01)
*H01R 13/40* (2006.01)

(52) U.S. Cl.
CPC ..... *H01R 13/629* (2013.01); *H01R 13/639* (2013.01)

(56) References Cited

U.S. PATENT DOCUMENTS 4,632,475 A * 12/1986 Tomita ..... H01R 35/04 439/31
4,657,320 A * 4/1987 Bamford ..... H01R 35/04 439/31
5,395,250 A * 3/1995 Englert, Jr. ..... H01R 12/58 439/876
5,971,784 A * 10/1999 Fabian ..... H01R 13/6315 439/224
5,989,040 A * 11/1999 Nishimatsu ..... H01R 12/725 439/680
6,042,389 A * 3/2000 Lemke ..... H01R 43/0256 439/74
6,406,336 B1 * 6/2002 Stansbury ..... H01R 13/422 439/876
6,461,178 B1 * 10/2002 Fu ..... H01R 31/06 439/224
6,802,748 B2 * 10/2004 Wertz ..... H01R 13/115 439/856
6,908,345 B2 * 6/2005 Shimizu ..... H01R 13/62905 439/682
6,974,344 B2 * 12/2005 Comerci ..... H01R 12/772 439/329
7,070,465 B2 * 7/2006 Masaki ..... H01R 12/75 439/850
7,112,102 B2 * 9/2006 Masaki ..... H01R 13/567 439/682
7,198,493 B2 * 4/2007 Chen ..... H01R 13/2442 439/66
7,387,521 B1 * 6/2008 Weber ..... H01R 13/28 439/31
7,549,892 B2 * 6/2009 Sawyers ..... H01R 13/113 439/500
7,828,585 B2 * 11/2010 Kurimoto ..... H01R 12/714 439/942
8,011,944 B2 * 9/2011 Umehara ..... H01R 12/88 439/345
8,043,114 B2 * 10/2011 Kaneko ..... H01R 12/775 439/468
8,206,159 B2 * 6/2012 Naito ..... H01R 12/7082 439/65
8,317,535 B2 * 11/2012 Yasui ..... H01R 12/724 439/378
8,337,259 B2 * 12/2012 Chen ..... H01R 13/432 439/751
8,678,849 B2 * 3/2014 Yang ..... H01R 24/68 439/374
8,727,813 B2 * 5/2014 Yang ..... H01R 12/732 439/682
9,048,569 B2 * 6/2015 Chen ..... H01R 13/6275
9,184,531 B2 * 11/2015 Chen ..... H01R 13/639
9,246,260 B2 * 1/2016 Naganawa ..... H01R 13/516
9,281,597 B2 * 3/2016 Hashiguchi ..... H01R 12/774
9,287,643 B2 * 3/2016 Yoshida ..... H01R 12/716
9,306,325 B2 * 4/2016 Cheng ..... H01R 13/6271
9,409,512 B2 * 8/2016 Stein ..... B60Q 1/2611
9,450,319 B2 * 9/2016 Nishimura ..... H01R 13/6273
9,559,467 B1 * 1/2017 Khorrami ..... H01R 13/6581
9,647,401 B2 * 5/2017 Sato ..... H01R 24/005
9,711,897 B2 * 7/2017 Ho ..... H01R 13/631
9,748,677 B2 * 8/2017 Urano ..... H01R 12/91
9,941,630 B2 * 4/2018 Sato ..... H01R 13/6272
10,680,366 B1 * 6/2020 Huang ..... H01R 12/725
10,707,603 B2 * 7/2020 Yufu ..... H01R 13/405
11,211,744 B2 * 12/2021 Zhu ..... H01R 12/7005
11,309,657 B1 * 4/2022 Lai ..... H01R 13/629
11,374,358 B2 * 6/2022 Kajiura ..... H01R 13/6273
11,381,035 B2 * 7/2022 Zhu ..... H01R 13/6273
2008/0045055 A1 2/2008 Chen et al.
2011/0306229 A1 * 12/2011 Katsui ..... H01R 13/629 439/345
2013/0178079 A1 7/2013 Yang et al.
2021/0305751 A1 * 9/2021 Chen ..... H01R 12/51

FOREIGN PATENT DOCUMENTS

JP 2013051080 A 3/2013
TW D176975 S 7/2016
TW I558023 B 11/2016

* cited by examiner

ELECTRICAL CONNECTION DEVICE AND TERMINAL

RELATED APPLICATIONS

The present application claims priority to Chinese Patent Application No. 202010222396.X filed Mar. 26, 2020 which is incorporated by reference in its entirety.

TECHNICAL FIELD

The present disclosure relates to an electrical connection device, particularly relates to an electrical connection device and a terminal.

BACKGROUND

Chinese utility model patent application issuance publication No. CN202454786U discloses an electrical connector, the electrical connector allows a mating connector to mate therewith along a first direction or a second direction. However, the electrical connector and the mating connector essentially have only one mating mode, that is to say, whether the mating connector is mated with the electrical connector along the first direction or along the second direction, the mating connector always is positioned at the same orientation relative to the electrical connector. Because the electrical connector and the mating connector have only one mating mode, the electrical connector does not have a positioning structure which can provide a positioning function in two mating modes or a locking structure which can provide a locking function in the two mating modes.

In addition, when the mating connector and the electrical connector are mated with each other, a terminal protruding point of a clipping terminal of the electrical connector will contact a sheet-shaped terminal of the mating connector, the terminal protruding point generally is formed by a stamping manner, therefore a depressed hollow shape is generally formed on the other side surface opposite to a protruding surface where the terminal protruding point is present, such a terminal protruding point is easily collapsed due to hits and in turn is damaged, so this type of the electrical connector cannot be subjected to high times of plug. However, in order to overcome the deficiency that such a terminal is easily damaged, there is another terminal in which a clipping terminal does not have a terminal protruding point, but the clipping terminal is provided with a first guiding portion and a second guiding portion thereon, the first guiding portion and the second guiding portion are respectively positioned in a first direction and a second direction and are used to guide sheet-shaped terminal to enter, however, the clipping terminal generally has a smaller volume, therefore, that clipping terminal is formed with the first guiding portion and the second guiding portion thereon which are perpendicular to each other not only is time-consuming and laborious but also increases the manufacturing cost.

SUMMARY

Therefore, an object of the present disclosure is to provide an electrical connection device which can improve at least one deficiency in the prior art.

Accordingly, in some embodiments, an electrical connection device of the present disclosure comprises a first connector and a second connector. The first connector comprises an insulative body and a plurality of first terminals provided to the insulative body, the insulative body has an insertion groove, a first insertion opening which is communicated with the insertion groove and toward a first direction, a second insertion opening which is communicated with the insertion groove and toward a second direction and a stopping block which is positioned between the first insertion opening and the second insertion opening, the stopping block has a first stopping face which faces the first direction and a second stopping face which faces the second direction. The second connector comprises an insulative housing and a plurality of second terminals provided to the insulative housing, the insulative housing has a mating portion and a contacting surface, when the second connector is mated with the first connector along the first direction, the mating portion is inserted into the insertion groove from the first insertion opening, and the contacting surface is stopped by the first stopping face of the stopping block, when the second connector is mated with the first connector along the second direction, the mating portion is inserted into the insertion groove from the second insertion opening, and the contacting surface is stopped by the second stopping face of the stopping block.

In some embodiments, the insulative housing further has a body portion, the mating portion extends forwardly from the body portion, and a shoulder is formed between the mating portion and the body portion, the shoulder forms the contacting surface which is toward the front.

In some embodiments, a guiding groove is formed on the mating portion and connected to the shoulder, the contacting surface is positioned at a rear end of the guiding groove, when the second connector is mated with the first connector along the first direction and when the second connector is mated with the first connector along the second direction, the stopping block is slidably received in the guiding groove.

In some embodiments, the insulative body has a bottom wall, two side walls and a rear wall, the bottom wall, the two side walls and the rear wall together define the insertion groove.

In some embodiments, the insulative body has two side walls, the first insertion opening is defined by the first stopping face and front end faces of the two side walls, the second insertion opening is defined by the second stopping face and top faces of the two side walls.

In some embodiments, the plurality of first terminals are sheet-shaped terminals which each extend along the first direction and the second direction, a part toward the first insertion opening and a part toward the second insertion opening of each first terminal each are formed with a guiding edge portion, the plurality of second terminals are clipping terminals which are used to clip the plurality of first terminals respectively.

In some embodiments, the insulative body is formed with a first fool-proof structure which extends along the first direction and a second fool-proof structure which extends along the second direction, the mating portion of the insulative housing is formed with a third fool-proof structure which corresponds to the first fool-proof structure and a fourth fool-proof structure which corresponds to the second fool-proof structure, when the second connector is mated with the first connector along the first direction, the first fool-proof structure and the third fool-proof structure correspondingly cooperate with each other in concave-convex fit, when the second connector is mated with the first connector along the second direction, the second fool-proof structure and the fourth fool-proof structure correspondingly cooperate with each other in concave-convex fit.

In some embodiments, the first fool-proof structure is a protruding key, the second fool-proof structure is a guiding slot, the third fool-proof structure is a key groove, the fourth fool-proof structure is a protruding rail.

Accordingly, in some embodiments, an electrical connection device of the present disclosure comprises a first connector and a second connector. The first connector comprises an insulative body and a plurality of first terminals provided to the insulative body, the insulative body has an insertion groove, a first insertion opening which is communicated with the insertion groove and toward a first direction, a second insertion opening which is communicated with the insertion groove and toward a second direction and a first positioning structure and a second positioning structure which are formed to an inner wall surface of the insertion groove. The second connector comprises an insulative housing and a plurality of second terminals provided to the insulative housing, the insulative housing has a mating portion and a third positioning structure formed to the mating portion, when the second connector is mated with the first connector along the first direction, the mating portion is inserted into the insertion groove from the first insertion opening, and the third positioning structure and the first positioning structure correspondingly cooperate with each other in concave-convex fit, when the second connector is mated with the first connector along the second direction, the mating portion is inserted into the insertion groove from the second insertion opening, and the third positioning structure and the second positioning structure correspondingly cooperate with each other in concave-convex fit.

In some embodiments, the insulative body has a bottom wall, two side walls and a rear wall, the bottom wall, the two side walls and the rear wall together define the insertion groove, the first positioning structure is formed to the rear wall, the second positioning structure is formed to the bottom wall, the third positioning structure is formed to a front end of the mating portion of the insulative housing.

In some embodiments, the first positioning structure and the second positioning structure are positioning recesses, the third positioning structure is a positioning protrusion.

In some embodiments, the plurality of first terminals are sheet-shaped terminals which each extend along the first direction and the second direction, a part toward the first insertion opening and a part toward the second insertion opening of each first terminal each are formed with a guiding edge portion, the plurality of second terminals are clipping terminals which are used to clip the plurality of first terminals respectively.

In some embodiments, the insulative body is formed with a first fool-proof structure which extends along the first direction and a second fool-proof structure which extends along the second direction, the mating portion of the insulative housing is formed with a third fool-proof structure which corresponds to the first fool-proof structure and a fourth fool-proof structure which corresponds to the second fool-proof structure, when the second connector is mated with the first connector along the first direction, the first fool-proof structure and the third fool-proof structure correspondingly cooperate with each other in concave-convex fit, when the second connector is mated with the first connector along the second direction, the second fool-proof structure and the fourth fool-proof structure correspondingly cooperate with each other in concave-convex fit.

In some embodiments, the first fool-proof structure is a protruding key, the second fool-proof structure is a guiding slot, the third fool-proof structure is a key groove, the fourth fool-proof structure is a protruding rail.

Accordingly, in some embodiments, an electrical connection device of the present disclosure comprises a first connector and a second connector. The first connector comprises an insulative body and a plurality of first terminals provided to the insulative body, the insulative body has an insertion groove, a first insertion opening which is communicated with the insertion groove and toward a first direction, a second insertion opening which is communicated with the insertion groove and toward a second direction and a locking recess which is formed to an inner wall surface of the insertion groove. The second connector comprises an insulative housing and a plurality of second terminal provided to the insulative housing, the insulative housing is provided with an elastic locking bar, the elastic locking bar is integrally connected with the insulative housing respectively at two ends of the elastic locking bar and is capable of being pressed, the elastic locking bar has a locking protrusion, when the second connector is mated with the first connector along the first direction and when the second connector is mated with the first connector along the second direction, the locking protrusion enters into the locking recess so as to lock the insulative housing to the insulative body.

In some embodiments, the insulative body has two side walls which define the insertion groove, the locking recess is formed to the side wall.

In some embodiments, the plurality of first terminals are sheet-shaped terminals which each extend along the first direction and the second direction, a part toward the first insertion opening and a part toward the second insertion opening of each first terminal each are formed with a guiding edge portion, the plurality of second terminals are clipping terminals which are used to clip the plurality of first terminals respectively.

In some embodiments, the insulative body is formed with a first fool-proof structure which extends along the first direction and a second fool-proof structure which extends along the second direction, the mating portion of the insulative housing is formed with a third fool-proof structure which corresponds to the first fool-proof structure and a fourth fool-proof structure which corresponds to the second fool-proof structure, when the second connector is mated with the first connector along the first direction, the first fool-proof structure and the third fool-proof structure correspondingly cooperate with each other in concave-convex fit, when the second connector is mated with the first connector along the second direction, the second fool-proof structure and the fourth fool-proof structure correspondingly cooperate with each other in concave-convex fit.

In some embodiments, the first fool-proof structure is a protruding key, the second fool-proof structure is a guiding slot, the third fool-proof structure is a key groove, the fourth fool-proof structure is a protruding rail.

Therefore, an object of the present disclosure is to provide a terminal which can improve at least one deficiency in the prior art.

Accordingly, in some embodiments, a terminal of the present disclosure has a sheet body, the sheet body has a first surface and a second surface which are opposite, a top edge, a bottom edge and two side edges, the sheet body is provided with a protuberance which is formed to the first surface, two fixed portions which are respectively formed to the two side edges and extend outwardly and pits which are formed to the first surface and the second surface adjacent to the bottom edge.

In some embodiments, the pits on the first surface are positioned between the protuberance and the bottom edge.

In some embodiments, the protuberance is formed by a stamping manner, so that the second surface is formed with a depression corresponding to the protuberance, the pits on the second surface are positioned between the depression and the bottom edge.

Accordingly, in some embodiments, a terminal of the present disclosure has a mating segment, the mating segment has a base plate which extends forwardly and two side plates which are connected to two sides of the base plate, the base plate and the two side plates together define a mating space, the mating space has a mating opening which is toward the front, each side plate has a frame body, at least one elastic arm and a plurality of contact portions, the plurality of contact portions enter into the mating space, each frame body has a side frame bar which is spaced apart from the base plate and arranged with the base plate side by side, one of the plurality of contact portions of each side plate is formed to the side frame bar, the other of the plurality of contact portions of each side plate is formed to the at least one elastic arm, and distances between the plurality of contact portions of each side plate and the mating opening at least have two different lengths.

In some embodiments, the frame body further has a front frame bar and a rear frame bar which connect the side frame bar and the base plate, are spaced apart from each other in a front-rear direction and arranged side by side, the at least one elastic arm extends from the rear frame bar toward the front frame bar and is formed with the contact portion at a tip of the at least one elastic arm.

In some embodiments, the contact portion of the at least one elastic arm is close to the mating opening relative to the contact portion of the side frame bar, the at least one elastic arm comprises a first elastic arm and a second elastic arm, the first elastic arm is positioned between the second elastic arm and the side frame bar, and the contact portion of the first elastic arm is closest to the mating opening.

In some embodiments, the frame body further has a front frame bar and a rear frame bar which connect the side frame bar and the base plate, are spaced apart from each other in the front-rear direction and arranged side by side, the at least one elastic arm comprises a first elastic arm and a second elastic arm, the first elastic arm and the second elastic arm extend from the rear frame bar toward the front frame bar, the first elastic arm is formed with the contact portion at a tip of the first elastic arm and the second elastic arm is formed with the contact portion at a tip of the second elastic arm, the contact portion of the first elastic arm or the contact portion of the second elastic arm is close to the mating opening relative to the contact portion of the side frame bar.

In some embodiments, the frame body further has a front frame bar and a rear frame bar which connect the side frame bar and the base plate, are spaced apart from each other in the front-rear direction and arranged side by side, the at least one elastic arm comprises a first elastic arm and a second elastic arm, the first elastic arm and the second elastic arm extend from the rear frame bar toward the front frame bar, the first elastic arm is formed with the contact portion at a tip of the first elastic arm and the second elastic arm is formed with the contact portion at a tip of the second elastic arm, a distance between the contact portion of the first elastic arm and the mating opening, a distance between the contact portion of the second elastic arm and the mating opening and a distance between the contact portion of the side frame bar and the mating opening all are not the same.

In some embodiments, a stopping portion is formed between end portions of the rear frame bar of the two side plates away from the base plate.

In some embodiments, the terminal further has a wire connection segment which is connected to a rear end of the mating segment and used to electrically connect a conductive wire.

In some embodiments, the at least one elastic arm of each side plate is connected to the frame body and encircled by the frame body.

In the electrical connection device of the present disclosure, with the first insertion opening and the second insertion opening of the first connector which are toward different directions respectively, the second connector can be mated with the first connector along different directions, and whether the second connector is mated with the first connector along the front-rear direction or along the up-down direction, the stopping block of the first connector and the contacting surfaces and the guiding grooves of the second connector provide a stopping and guiding function.

In the electrical connection device of the present disclosure, with the first positioning structure and the second positioning structure of the first connector and the second connector of third positioning structure, whether the second connector is mated with the first connector along the front-rear direction or along the up-down direction, a positioning function can be provided.

In the electrical connection device of the present disclosure, with the locking protrusion of the elastic locking bar of the second connector and the locking recess of the first connector, when the second connector is mated with the first connector along the front-rear direction and when the second connector is mated with the first connector along the up-down direction, a locking function is provided so as to prevent the second connector and the first connector being separated from each other. Also, because the two ends of the elastic locking bar are integrally connected to the insulative housing, it may prevent the two elastic locking bars and other cables to be entangled and dragged with each other.

In the terminal of the present disclosure, with a design of the protuberance and the pits, it provides better holding force and avoids solder wicking being too high when soldered at the same time.

In the terminal of the present disclosure, the frame bodies of the two side plates provide the contact portions used to contact, increase the whole structure strength of the second terminal, and at the same time function as protecting the at least one elastic arm. And distances between the plurality of contact portions and the mating opening at least have two different lengths, therefore, in hot plug, an electrical spark may be intended to only be generated at the contact portion which has the shortest distance from the mating opening, which can avoid the electrical spark affecting other contact portion in hot plug, also, the plurality of contact portions which has different distances from the mating opening also may lower insertion force during mating.

BRIEF DESCRIPTION OF THE DRAWINGS

Other features and effects of the present disclosure will be apparent from an embodiment illustrated in the drawings, in which.

DETAILED DESCRIPTION OF THE PREFERRED EMBODIMENTS

Figure 1:
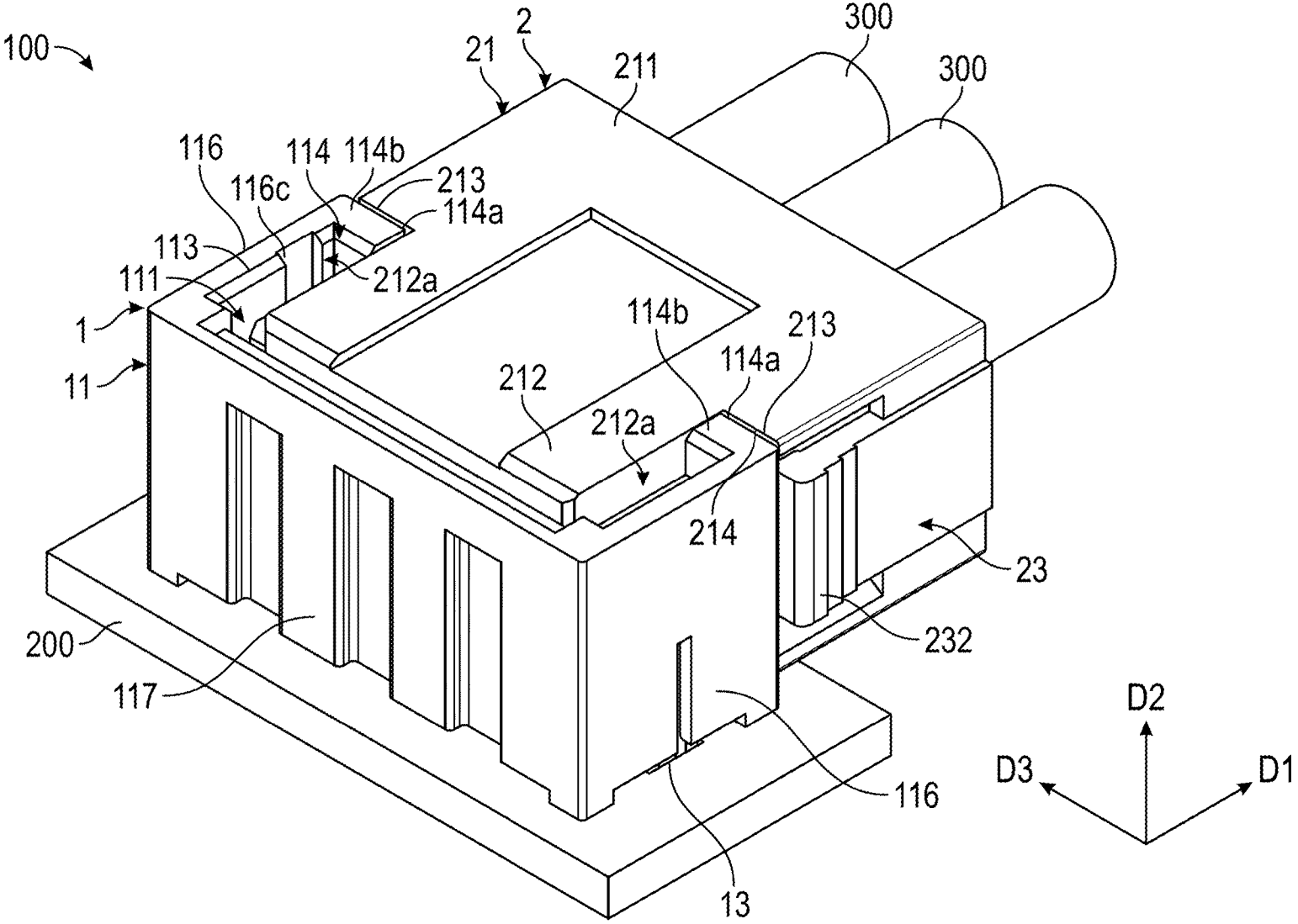
FIG. 1 is a perspective view of an embodiment of an electrical connection device of the present disclosure with a first connector and a second connector mated with in a front-rear direction.

Before the present disclosure is described in detail, it should be noted that the similar components are indicated by the same reference numerals in the following description.

Figure 2:
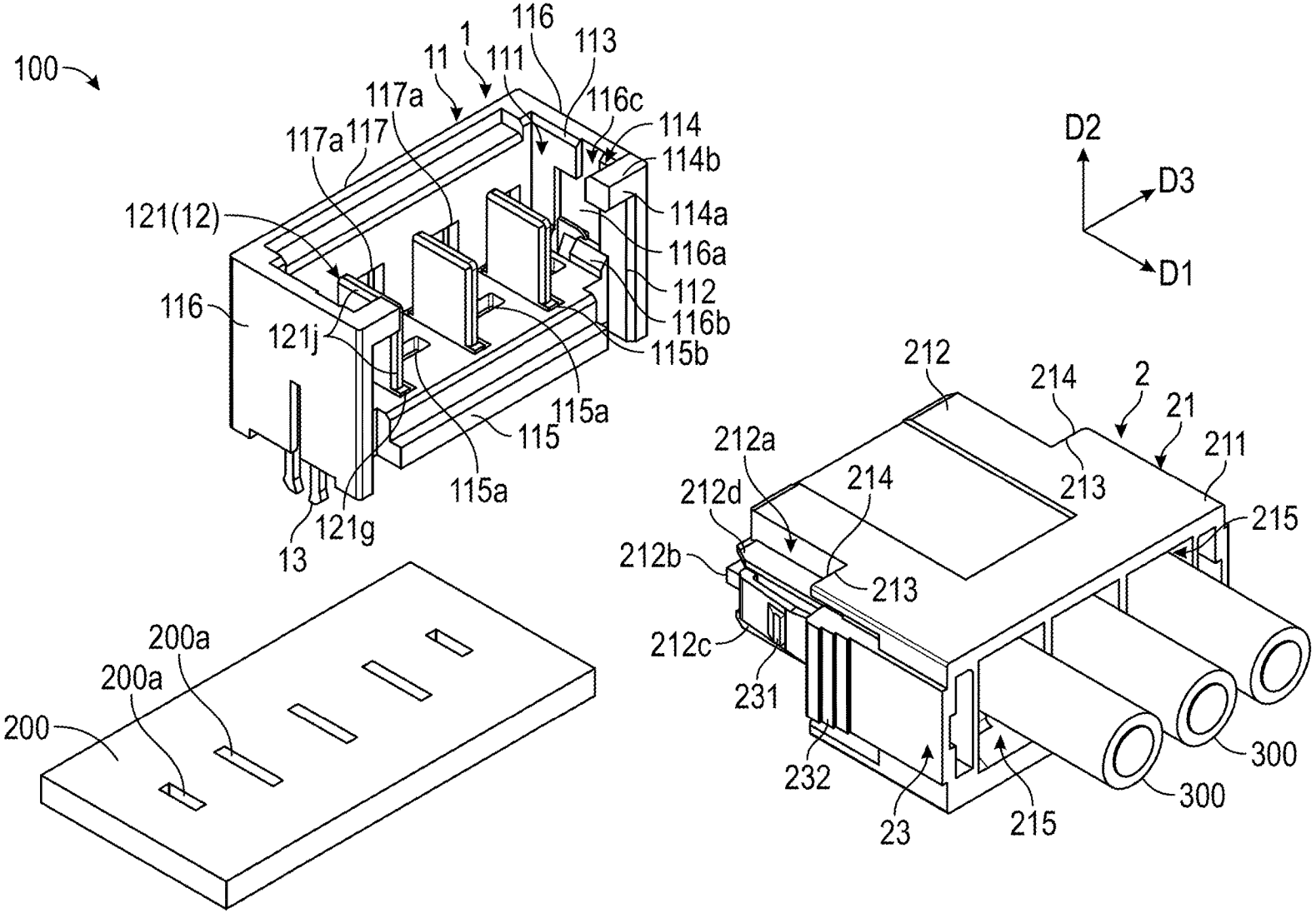
FIG. 2 is a perspective exploded view of FIG. 1.
Figure 3:
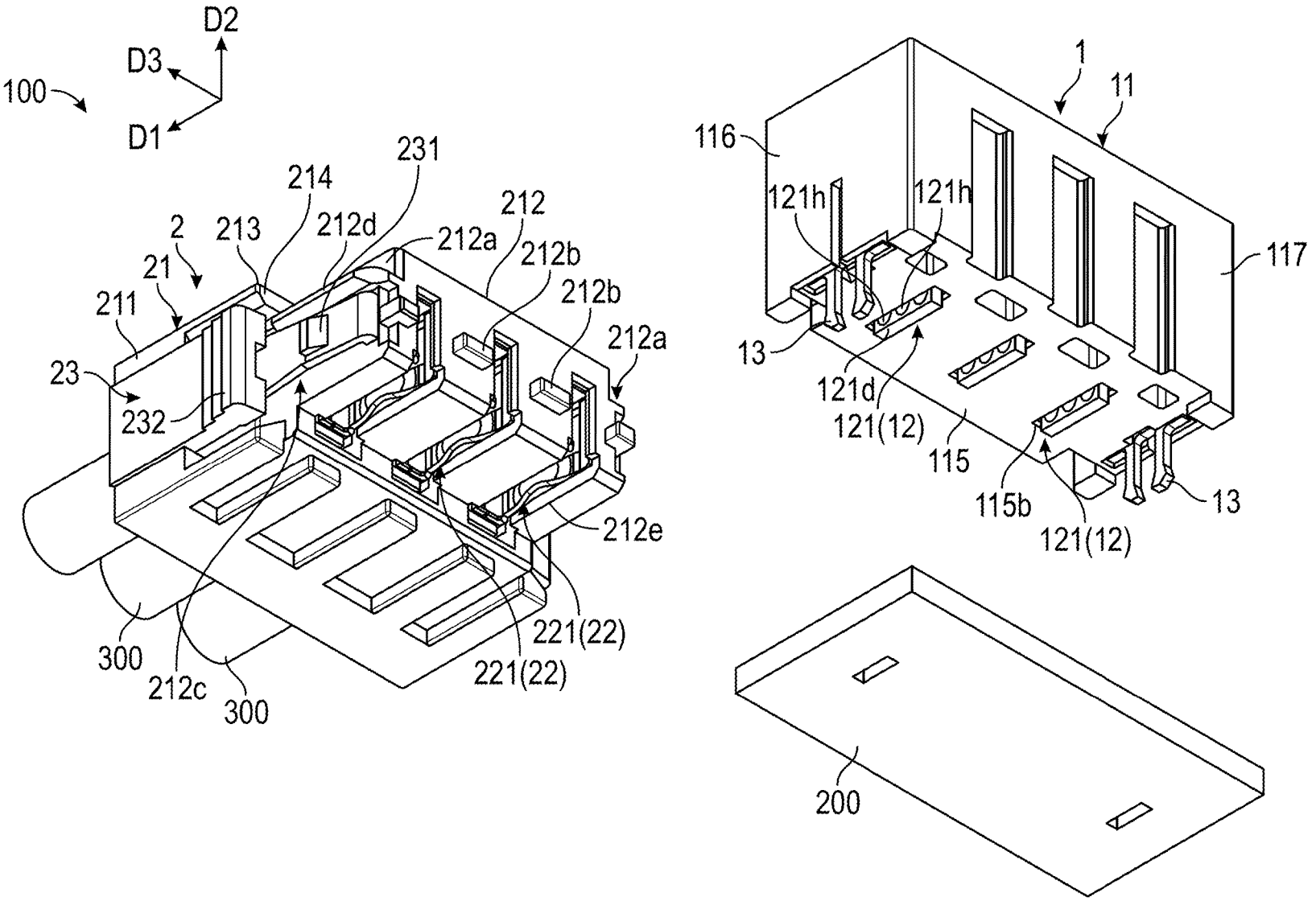
FIG. 3 is a perspective exploded view viewed from another angle of FIG. 2.
Figure 4:
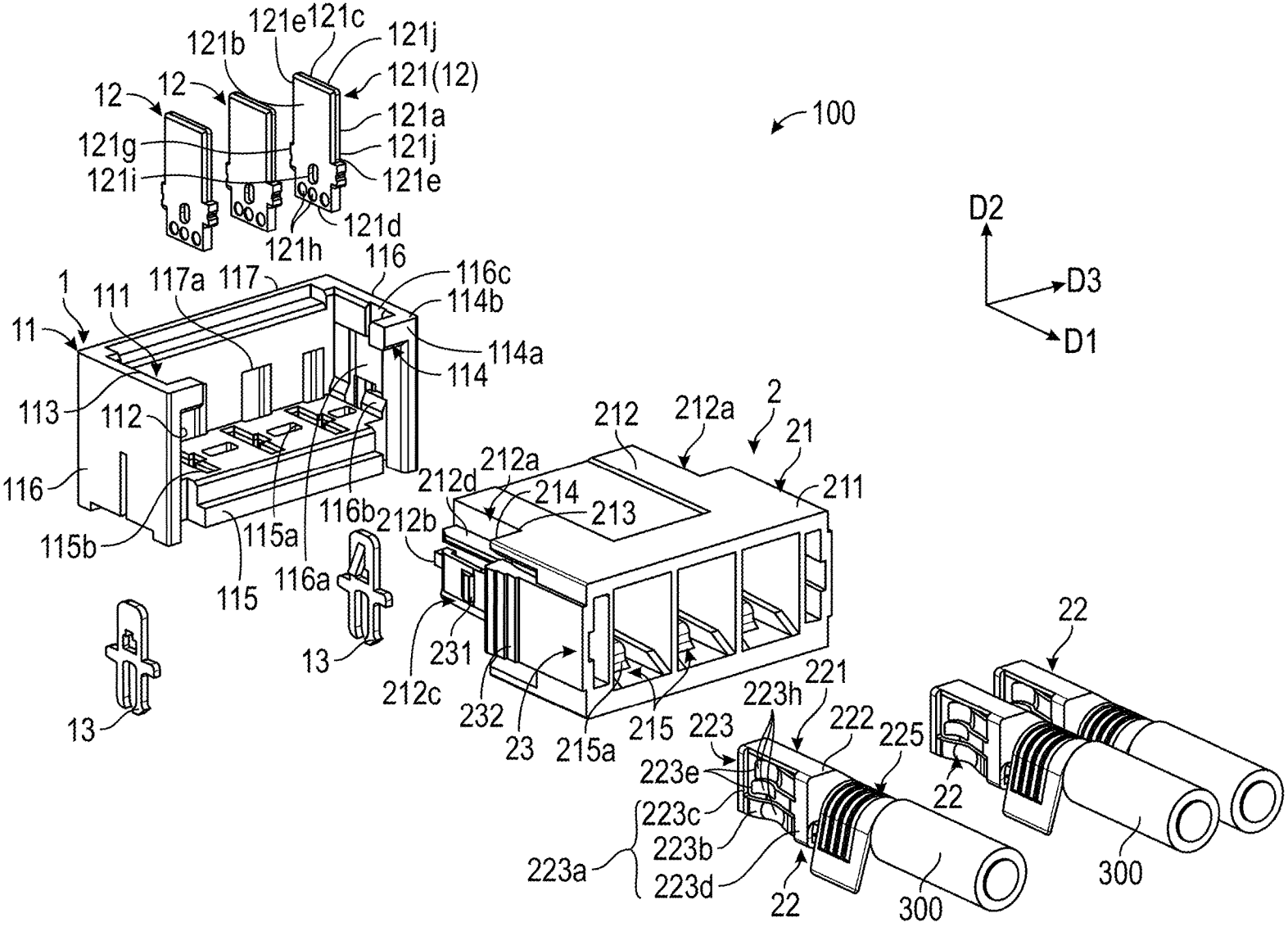
FIG. 4 is a perspective exploded view further on a basis of FIG. 2.
Figure 5:
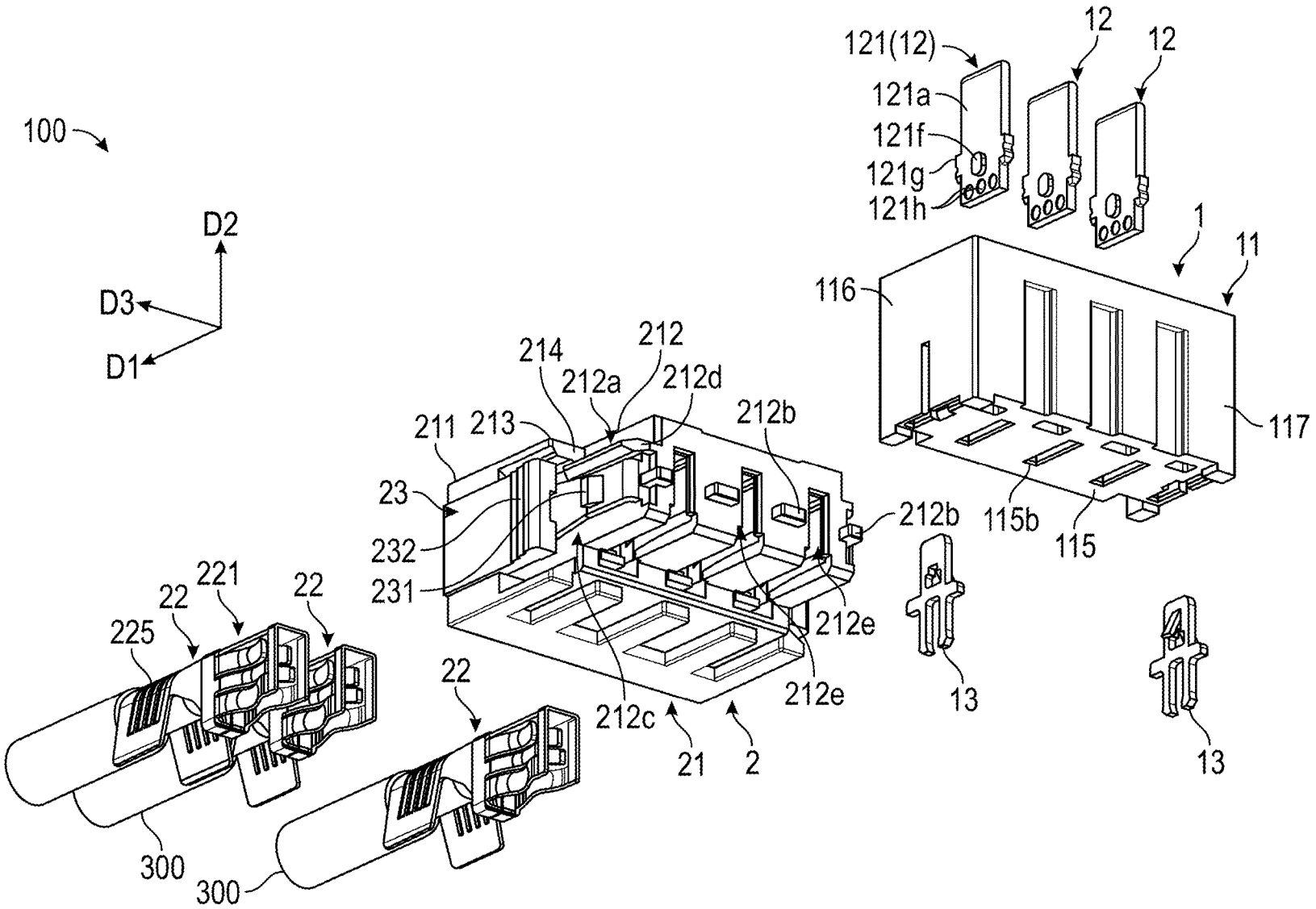
FIG. 5 is a perspective exploded view viewed from another angle of FIG. 4.
Figure 6:
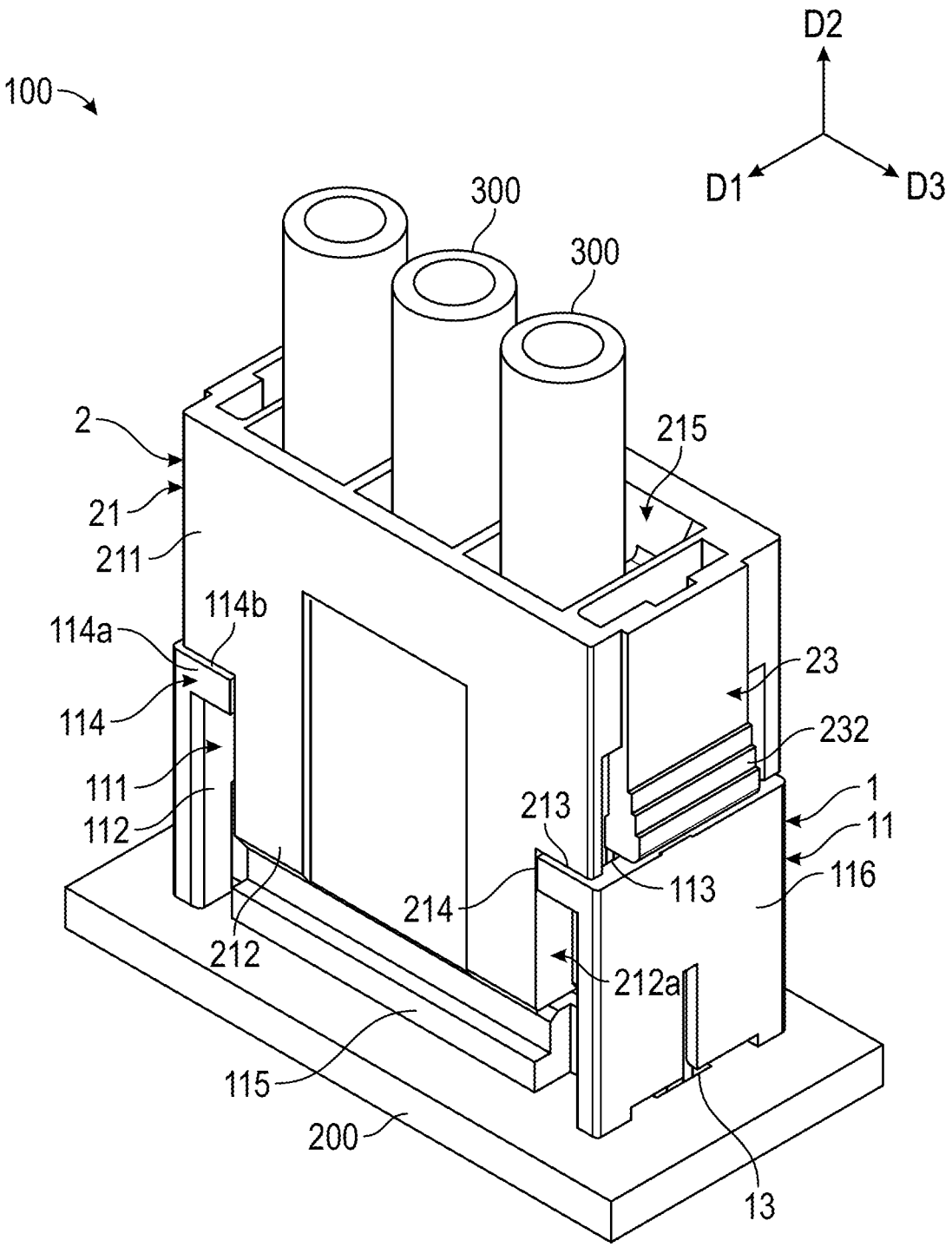
FIG. 6 is a perspective view of the embodiment of FIG. 2 with the first connector and the second connector mated with in an up-down direction.
Figure 7:
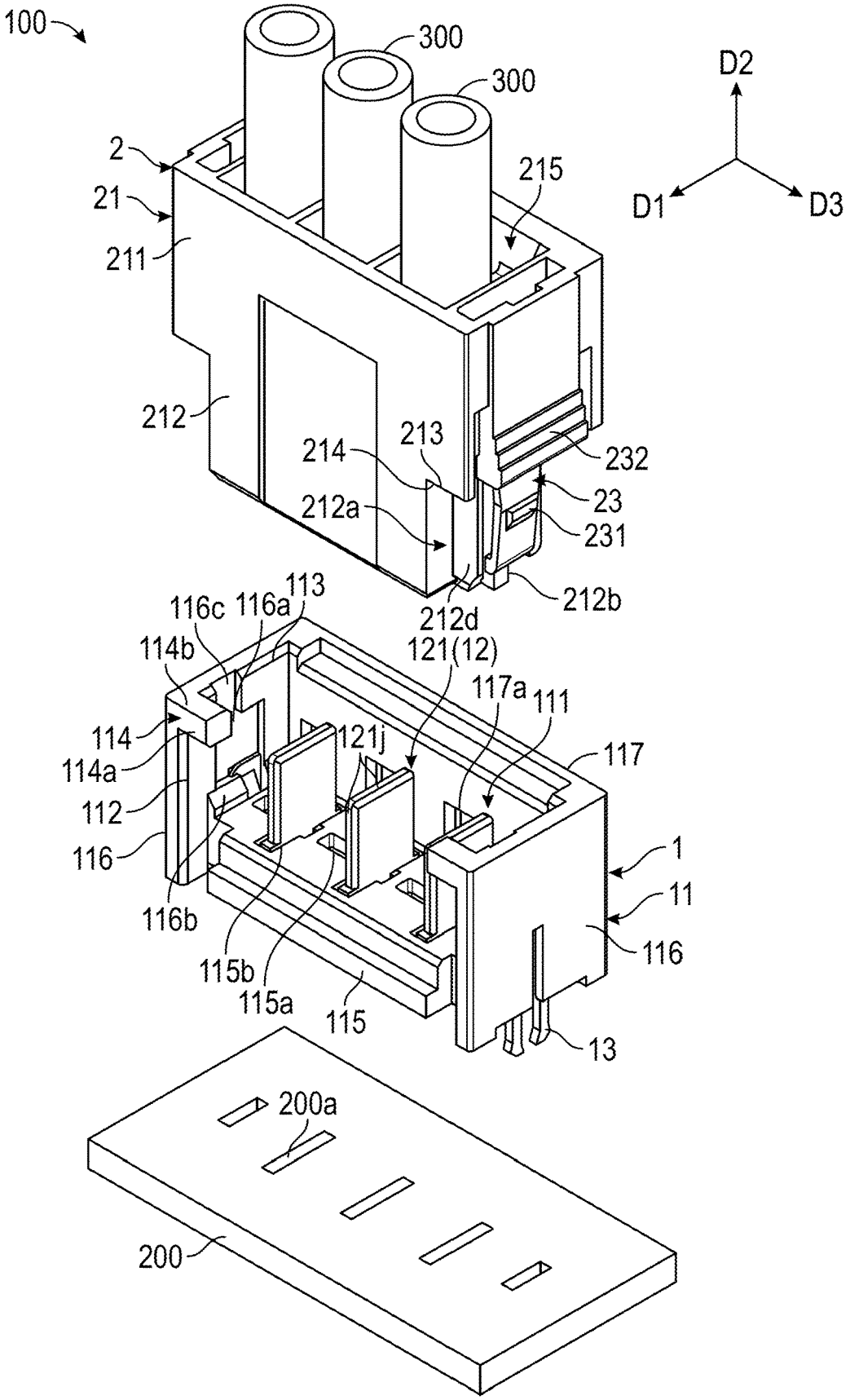
FIG. 7 is a perspective exploded view of FIG. 6.
Figure 8:
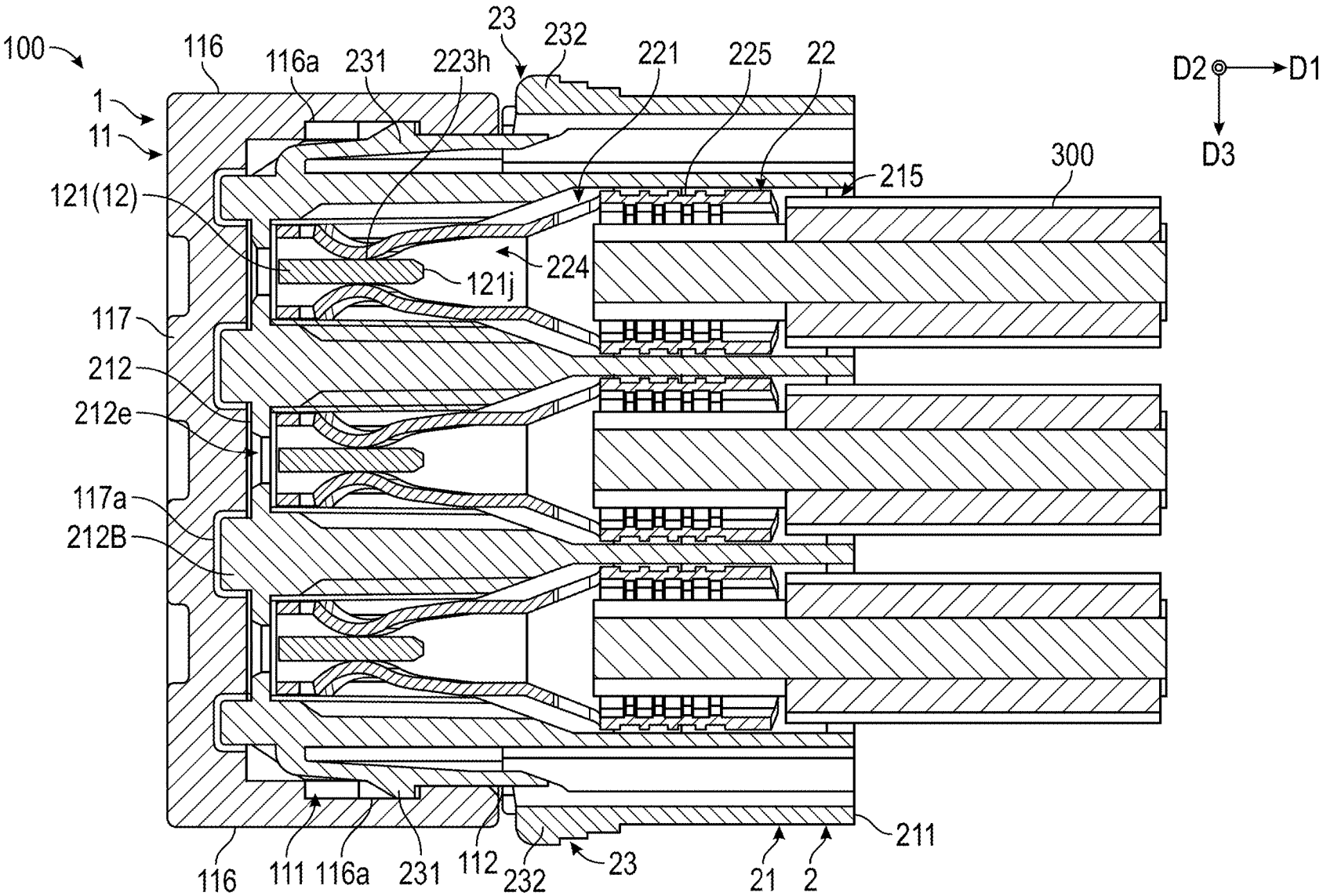
FIG. 8 is a cross sectional view of FIG. 1 illustrating a cooperation relationship between a locking recess of the first connector and a locking protrusion of an elastic locking bar of the second connector.
Figure 9:
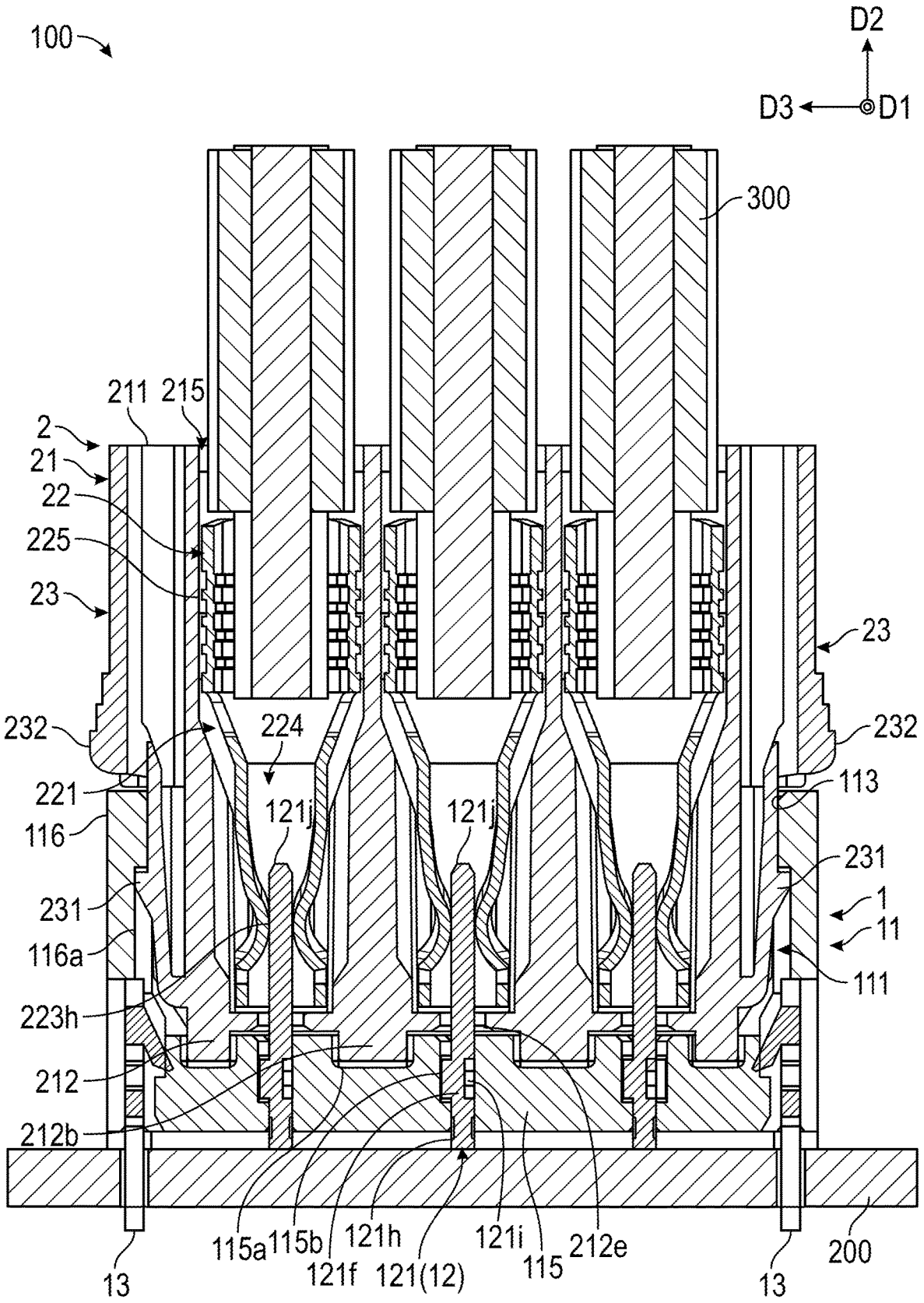
FIG. 9 is a cross sectional view of FIG. 6 illustrating a cooperation relationship between the locking recess of the first connector and the locking protrusion of the elastic locking bar of the second connector.
Figure 11:
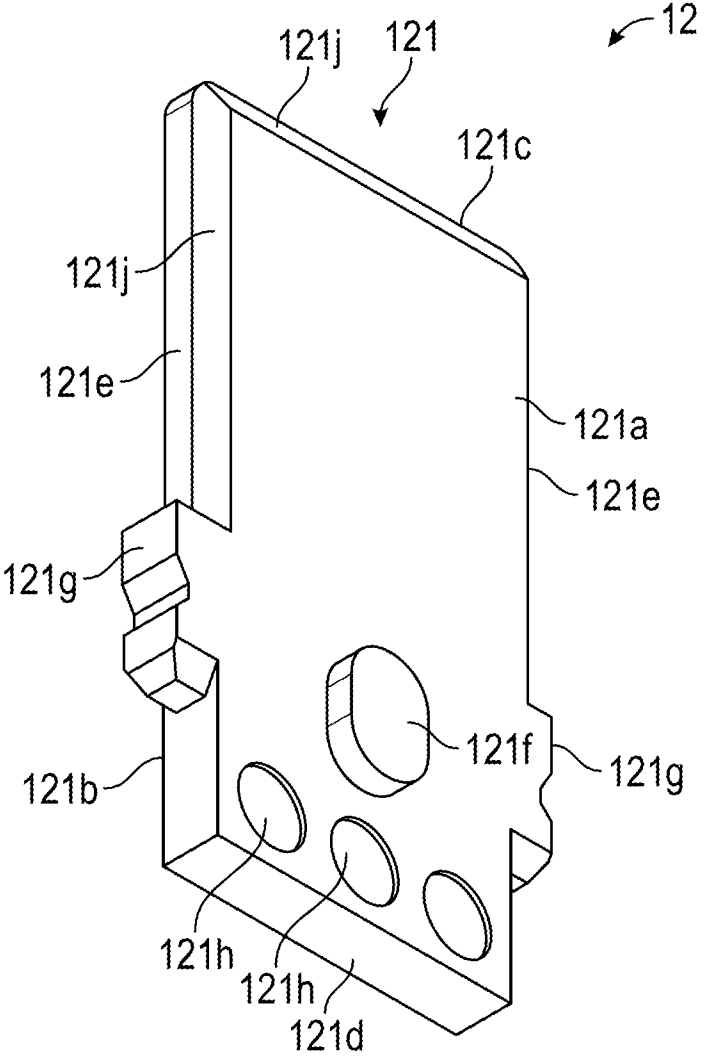
FIG. 11 is a perspective view viewed from another angle of FIG. 10.
Figure 10:
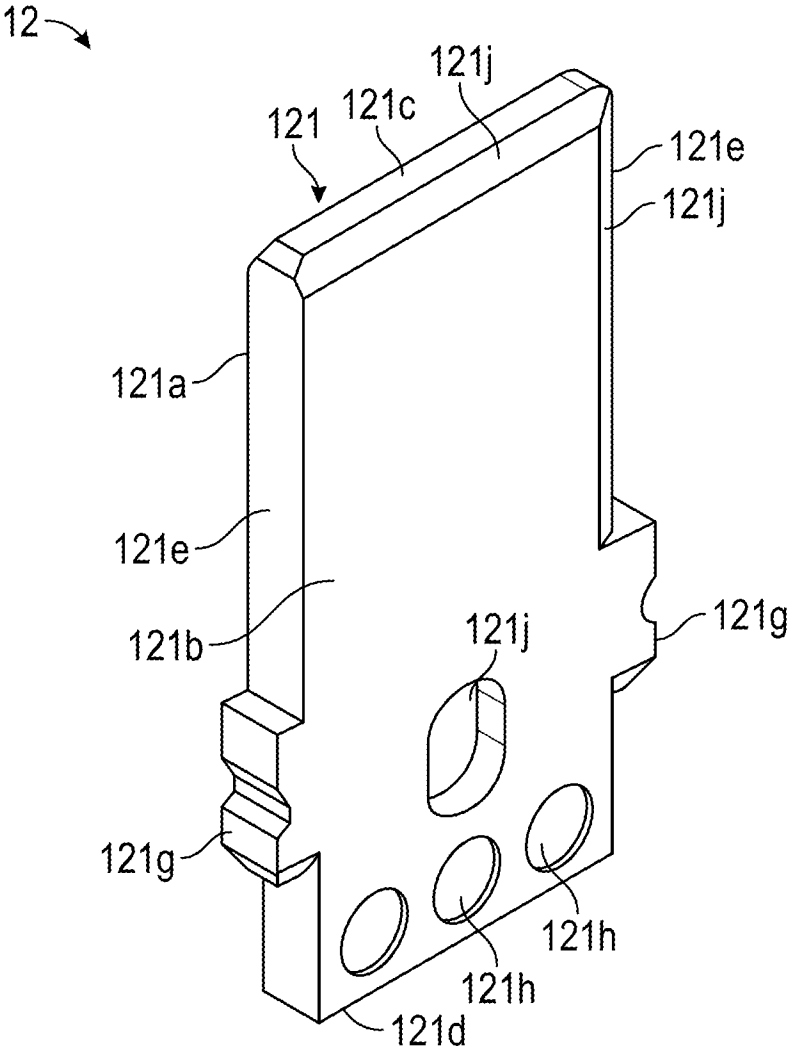
FIG. 10 is a perspective view of a first terminal of the first connector of the embodiment.
Figure 12:
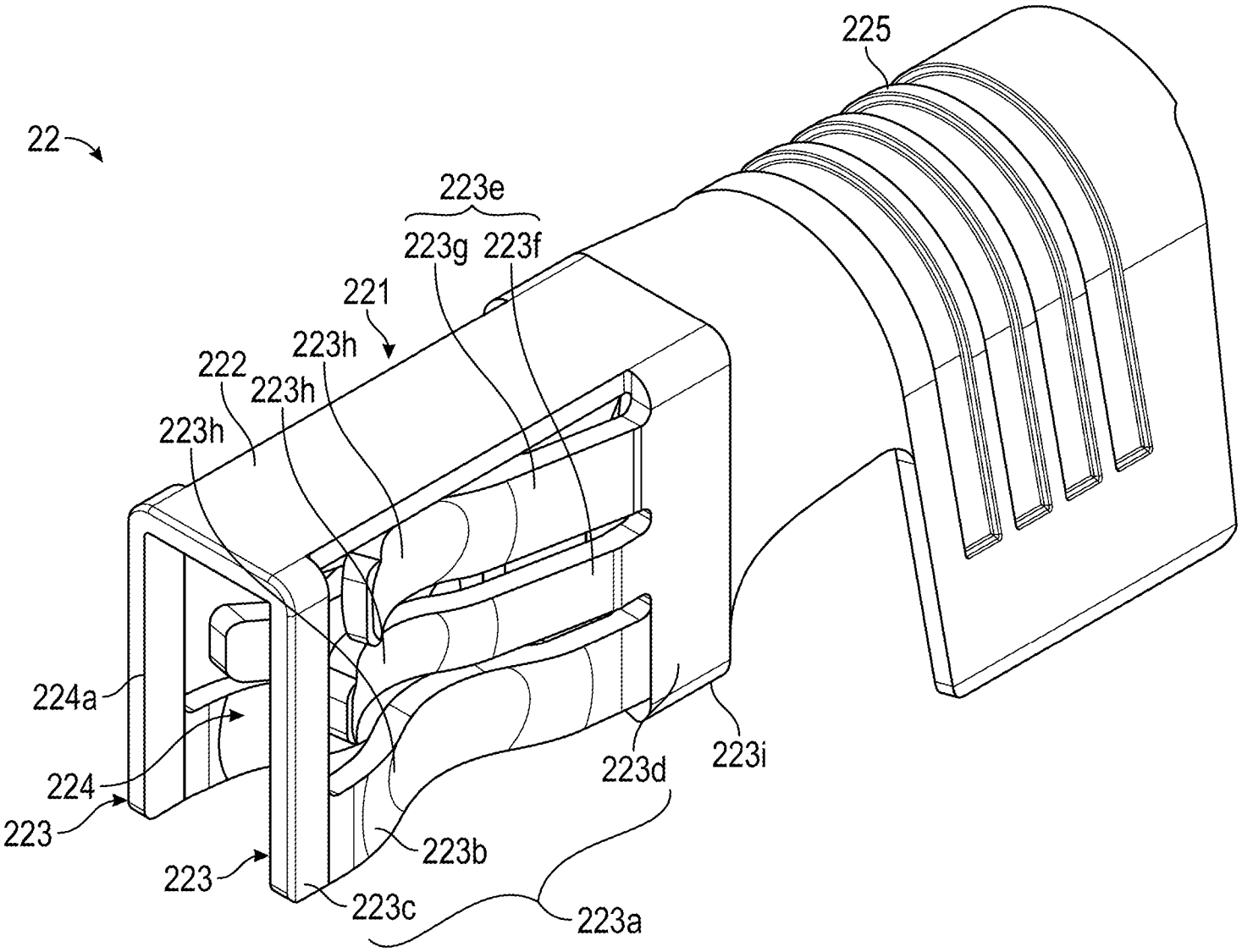
FIG. 12 is a perspective view of a second terminal of the second connector of the embodiment.

Referring to FIG. 1 to FIG. 3, an embodiment of an electrical connection device 100 of the present disclosure includes a first connector 1 and a second connector 2.

Referring to FIG. 1 to FIG. 5, the first connector 1 includes an insulative body 11 and a plurality of first terminals 12 provided to the insulative body 11. The insulative body 11 is fixed to a circuit board 200 by two latching members 13, the plurality of first terminals 12 respectively are electrically and mechanically connected to a plurality of circuit connection points 200*a* of the circuit board 200 by a manner, for example, welding. The insulative body 11 has an insertion groove 111, a first insertion opening 112 which is communicated with the insertion groove 111 and is toward the front along a front-rear direction D1, a second insertion opening 113 which is communicated with the insertion groove 111 and toward the up along an up-down direction D2 and a stopping block 114 which is positioned between the first insertion opening 112 and the second insertion opening 113, the stopping block 114 has a first stopping face 114*a* which faces the front-rear direction D1 and a second stopping face 114*b* which faces the up-down direction D2. It is noted that, although the first insertion opening 112 and the second insertion opening 113 are respectively toward the front and the up in the present embodiment, in other implementing manners, the first insertion opening 112 and the second insertion opening 113 also may be toward other two directions which are different from each other, so the present disclosure is not limited to the present embodiment. Specifically, the insulative body 11 has a bottom wall 115 which is positioned at the down, two side walls 116 which respectively extend upwardly from two sides of the bottom wall 115 in a left-right direction D3 and a rear wall 117 which is connected to a rear edge of the bottom wall 115 and rear edges of the two side walls 116. The bottom wall 115, the two side walls 116 and the rear wall 117 together define the insertion groove 111. The number of the stopping block 114 in the present embodiment is two, and the two stopping blocks 114 extend inwardly from top portions of front ends of the two side walls 116. The first insertion opening 112 is defined by the first stopping faces 114*a*, a front end face of the bottom wall 115 and front end faces of the two side walls 116, the second insertion opening 113 is defined by the second stopping faces 114*b*, a top face of the bottom wall 115 and top faces of the two side walls 116.

The second connector 2 includes an insulative housing 21 and a plurality of second terminals 22 provided to the insulative housing 21. The plurality of second terminals 22 respectively electrically and mechanically connected to a plurality of conductive wires 300. In the present embodiment, the insulative housing 21 has a body portion 211 and a mating portion 212 extending forwardly from the body portion 211. Two shoulders 213 are formed between the mating portion 212 and the body portion 211, the two shoulders 213 respectively form two contacting surfaces 214 which are toward the front, and two guiding grooves 212*a* are formed on the mating portion 212 and connected to the two shoulders 213 respectively, the two contacting surfaces 214 are positioned to inner wall surfaces of the mating portion 212 which are respectively at rear ends of the two guiding grooves 212*a*. It is noted that, the two contacting surfaces 214 also may be not formed to the two shoulders 213 respectively but are formed to other parts of the insulative housing 21.

Referring to FIG. 1, FIG. 2, FIG. 6 and FIG. 7, when the second connector 2 is mated with and the first connector 1 along the front-rear direction D1, the mating portion 212 is inserted into the insertion groove 111 from the first insertion opening 112, and the two contacting surfaces 214 are stopped by the first stopping faces 114*a* of the two stopping blocks 114 respectively; when the second connector 2 is mated with the first connector 1 along the up-down direction D2, the mating portion 212 is inserted into the insertion groove 111 from the second insertion opening 113, and the two contacting surfaces 214 are stopped by the second stopping faces 114*b* of the two stopping blocks 114 respectively. When the second connector 2 is mated with the first connector 1 along the front-rear direction D1 and when the second connector 2 is mated with the first connector 1 along the up-down direction D2, the two stopping blocks 114 are slidably received in the two guiding grooves 212*a* respectively. With the first insertion opening 112 and the second insertion opening 113 of the first connector 1 which are toward different directions respectively, the second connector 2 can be mated with the first connector 1 along different directions, and whether the second connector 2 is mated with the first connector 1 along the front-rear direction D1 or along the up-down direction D2, the stopping blocks 114 of the first connector 1 and the contacting surfaces 214 and the guiding grooves 212*a* of the second connector 2 provide a stopping and guiding function. It is noted that, when a direction of the second connector 2 is described, the front refers to a direction that the second connector 2 is relatively toward the first connector 1 when the second connector 2 is mated with the first connector 1, the rear refers to a direction that the second connector 2 is relatively away from the first connector 1 when the second connector 2 is mated with the first connector 1. In addition, although the number of the stopping block 114, the number of the guiding groove 212*a*, the number of the shoulder 213 and the number of the contacting surface 214 each are two in the present embodiment, it can be understood that, in other implementing manners, the number of them also may be each one or three or more, so the present disclosure is not limited to the present embodiment.

Referring to FIG. 2, FIG. 3 and FIG. 7 to FIG. 9, as for a positioning function between the first connector 1 and the second connector 2, the insulative body 11 of the first connector 1 further has a plurality of first positioning structures 117*a* and a plurality of second positioning structures 115*a* which are formed to an inner wall surface of the insertion groove 111, specifically, the plurality of first positioning structures 117*a* are formed to the rear wall 117, the plurality of second positioning structures 115*a* are formed to the bottom wall 115. The insulative housing 21 of the second connector 2 further has a plurality of third positioning structures 212*b* which are formed to the mating portion 212, specifically, the plurality of third positioning structures 212*b* are formed to a front end of the mating portion 212 of the insulative housing 21. When the second connector 2 is mated with the first connector 1 along the front-rear direction D1, the mating portion 212 is inserted into the insertion groove 111 from the first insertion opening 112, and the plurality of third positioning structures 212*b* and the plurality of first positioning structures 117*a* correspondingly cooperate with each other in concave-convex fit; when the second connector 2 is mated with the first connector 1 along the up-down direction D2, the mating portion 212 is inserted into the insertion groove 111 from the second insertion opening 113, and the plurality of third positioning structures 212*b* and the plurality of second positioning structures 115*a* correspondingly cooperate with each other in concave-convex fit. In the present embodiment, the plurality of first positioning structures 117*a* and the plurality of second positioning structures 115*a* are positioning recesses, the plurality of third positioning structures 212*b* are positioning protrusions, but in other implementing manners, the plurality of first positioning structures 117*a* and the plurality of second positioning structures 115*a* also may be positioning protrusions, at this time the plurality of third positioning structures 212*b* are positioning recesses. In addition, although in the present embodiment, the number of the first positioning structure 117*a*, the number of the second positioning structure 115*a* and the number of the third positioning structure 212*b* each are four, in other implementing manners, the number of the first positioning structure 117*a*, the number of the second positioning structure 115*a* and the number of the third positioning structure 212*b* also may each be one, two, three or five or more, but the present disclosure is not limited thereto. With the first positioning structure 117*a* and the second positioning structure 115*a* of the first connector 1 and the second connector 2 of third positioning structure 212*b*, whether the second connector 2 is mated with the first connector 1 along the front-rear direction D1 or along the up-down direction D2, a positioning function can be provided.

As for a locking function between the first connector 1 and the second connector 2, the insulative body 11 of the first connector 1 further has two locking recesses 116*a* which are formed to the inner wall surface of the insertion groove 111, specifically, the two locking recesses 116*a* are formed to the two side walls 116 respectively. Two sides of the insulative housing 21 of the second connector 2 in the left-right direction D3 are respectively provided with two elastic locking bars 23 which each have two ends integrally connected with the insulative housing 21 respectively and each are capable of being pressed, the two elastic locking bars 23 extend in the front-rear direction D1, each elastic locking bar 23 has a locking protrusion 231 which is positioned close to the front and a pressing portion 232 which is positioned behind the locking protrusion 231 and can be pressed. When the second connector 2 is mated with the first connector 1 along the front-rear direction D1 and when the second connector 2 is mated with the first connector 1 along the up-down direction D2, the two locking protrusions 231 of the two elastic locking bars 23 enter into the two locking recesses 116*a* respectively, so as to lock the insulative housing 21 of the second connector 2 to the insulative body 11 of the first connector 1. At this time, when a user press down the two pressing portions 232 of the two elastic locking bars 23, the two locking protrusions 231 of the two elastic locking bars 23 will remove from the two locking recesses 116*a* respectively, thereby unlocking the insulative housing 21 of the second connector 2 from the insulative body 11 of the first connector 1. With the locking protrusion 231 of the elastic locking bar 23 of the second connector 2 and the locking recess 116*a* of the first connector 1, when the second connector 2 is mated with the first connector 1 along the front-rear direction D1 and when the second connector 2 is mated with the first connector 1 along the up-down direction D2, a locking function is provided so as to prevent the second connector 2 and the first connector 1 being separated from each other. Also, because the two ends of the elastic locking bar 23 are integrally connected to the insulative housing 21, it may prevent the two elastic locking bars 23 and other cables to be entangled and dragged with each other. Moreover, it is noted that, in other varied embodiments, the number of the locking recess 116*a* and the number of the elastic locking bar 23 also each may be only one, even each are three or more, so the present disclosure should be not limited to the number of the present embodiment.

Referring to FIG. 1 to FIG. 3 and FIG. 6 to FIG. 7, moreover, in the present embodiment, the insulative body 11 of the first connector 1 is formed with two first fool-proof structures 116*b* which extend along the front-rear direction D1 and two second fool-proof structures 116*c* which extend along the up-down direction D2, specifically, the two first fool-proof structures 116*b* are two protruding keys which are respectively formed to inner side surfaces of the two side walls 116 and extend along the front-rear direction D1, the two second fool-proof structures 116*c* are two guiding slots which are respectively formed to the inner side surfaces of the two side walls 116 of and extend along the up-down direction D2, the two guiding slots are communicated with the two locking recesses 116*a* respectively in the present embodiment. The mating portion 212 of the insulative housing 21 of the second connector 2 is formed with two third fool-proof structures 212*c* which correspond to the two first fool-proof structures 116*b* respectively and two fourth fool-proof structures 212*d* which correspond to the two second fool-proof structures 116*c* respectively. Specifically, the two third fool-proof structures 212*c* are two key grooves which extend in the front-rear direction D1 and cooperate with the two first fool-proof structures 116*b* (the two protruding keys) respectively, in the present embodiment, the two key grooves are defined by bottoms of the two elastic locking bars 23 and outer side surfaces of the insulative housing 21 of the mating portion 212, the two fourth fool-proof structure 212*d* are two protruding rails which extend in the front-rear direction D1 and cooperate with the two second fool-proof structures 116*c* (the two guiding slots) respectively, in the present embodiment, the two protruding rails are formed to the outer side surfaces of the mating portion 212 respectively, extend in the front-rear direction D1 and positioned above the two elastic locking bars 23 respectively. When the second connector 2 is mated with the first connector 1 along the front-rear direction D1, the two first fool-proof structures 116*b* and the two third fool-proof structures 212*c* correspondingly cooperate with each other in concave-convex fit; when the second connector 2 is mated with the first connector 1 along the up-down direction D2, the two second fool-proof structures 116*c* and the two fourth fool-proof structure 212*d* correspondingly cooperate with each other in concave-convex fit. With the cooperation relationship between the first fool-proof structure 116*b* and the third fool-proof structure 212*c* and the cooperation relationship between the second fool-proof structure 116*c* and the fourth fool-proof structure 212*d*, it can prevent the mating portion 212 of the insulative housing 21 of the second connector 2 from being inserted into the insertion groove 111 of the insulative body 11 of the first connector 1 in the front-rear direction D1 and the up-down direction D2 by a wrong manner. In addition, it is noted that, the number of the first fool-proof structure 116*b* and the number of the third fool-proof structure 212*c* and the number of the second fool-proof structure 116*c* and the number of the fourth fool-proof structure 212*d* all may be adjusted as desired, the number of them each also may be one or three or more, so the present disclosure should be not limited to the number of the present embodiment.

Referring to FIG. 2, FIG. 4, FIG. 10 and FIG. 11, each first terminal 12 is a sheet-shaped terminal which extends along the front-rear direction D1 and the up-down direction D2 and has a sheet body 121. The sheet body 121 has a first surface 121*a* and a second surface 121*b* which are opposite, a top edge 121*c*, a bottom edge 121*d* and two side edges 121*e*. The sheet body 121 is provided with a protuberance 121*f* which is formed to the first surface 121*a*, two fixed portions 121*g* which are respectively formed to the two side edges 121*e* and extend outwardly and pits 121*h* which are formed to the first surface 121*a* and the second surface 121*b* adjacent to the bottom edge 121*d*. A plurality of first fixing grooves 115*b* penetrate the bottom wall 115 of the insulative body 11 of the first connector 1 and are used to fix the plurality of first terminals 12 respectively, the two fixed portions 121*g* of each first terminal 12 are caught in the corresponding first fixing groove 115*b*, and the protuberance 121*f* interferes with an inner wall surface of the corresponding first fixing groove 115*b*. The bottom edges 121*d* of the plurality of first terminals 12 are welded to the circuit board 200 by a soldering manner, the pits 121*h* positioned on the first surface 121*a* are positioned between the protuberance 121*f* and the bottom edge 121*d*, the pits 121*h* can receive a solder, so as to avoid solder wicking being too high. In addition, in the present embodiment, the protuberance 121*f* is formed by a stamping manner and generally positioned between the two fixed portions 121*g*, so that the second surface 121*b* is formed with a depression 121*i* which corresponds to the protuberance 121*f*, and the pits 121*h* positioned on the second surface 121*b* are positioned between the depression 121*i* and the bottom edge 121*d*. With that the protuberance 121*f* interferes with the inner wall surface of the first fixing groove 115*b*, it can further increase a holding force between the plurality of first terminals 12 and the insulative body 11. Therefore, with a design of the protuberance 121*f* and the pits 121*h*, it provides better holding force and avoids solder wicking being too high when soldered at the same time.

Referring to FIG. 4, FIG. 5 and FIG. 12 to FIG. 14, the plurality of second terminals 22 are clipping terminals used to clip the plurality of first terminals 12 respectively, and each second terminal 22 has a mating segment 221 and a wire connection segment 225. The insulative housing 21 of the second connector 2 is formed with a plurality of second receiving grooves 215 which extend forwardly from a rear end surface of the insulative housing 21, and a plurality of mating holes 212*e* are formed to the front end of the mating portion 212 of the insulative housing 21, respectively communicated with the plurality of second receiving grooves 215 and opened at a bottom thereof, the plurality of second terminals 22 are respectively provided to the plurality of second receiving grooves 215 from the rear to the front, and the mating segments 221 of the plurality of second terminals 22 are received in the plurality of mating holes 212*e* respectively. When the first connector 1 is mated with the second connector 2, the first terminal 12 of the first connector 1 enters from the corresponding mating hole 212*e* to be clipped by and thus be mated with the mating segment 221 of the second terminal 22 in the corresponding mating hole 212*e*. The wire connection segment 225 is connected to a rear end of the mating segment 221 and used to electrically connect the corresponding conductive wire 300.

Specifically, the mating segment 221 has a base plate 222 which extends forwardly and two side plates 223 which are connected to two sides of the base plate 222 respectively. The base plate 222 and the two side plates 223 together define a mating space 224 which allows the first terminal 12 to enter into and has a mating opening 224*a* toward the front. Each side plate 223 has a frame body 223*a*, at least one elastic arm 223*e* and a plurality of contact portions 223*h*, the plurality of contact portions 223*h* enter into the mating space 224. Each frame body 223*a* has a side frame bar 223*b* which is spaced apart from the base plate 222 and arranged with the base plate 222 side by side and a front frame bar 223*c* and a rear frame bar 223*d* which connect the side frame bar 223*b* and the base plate 222, are spaced apart from each other in the front-rear direction D1 and arranged side by side. The at least one elastic arm 223*e* extends from the rear frame bar 223*d* toward the front frame bar 223*c*. One of the plurality of contact portions 223*h* of each side plate 223 is formed to the side frame bar 223*b* of the side plate 223, the other of the plurality of contact portions 223*h* is formed to the at least one elastic arm 223*e*. The frame bodies 223*a* of the two side plates 223 provide the contact portions 223*h* used to contact, increase the whole structure strength of the second terminal 22, and at the same time function as protecting the at least one elastic arm 223*e*. And distances between the plurality of contact portions 223*h* and the mating opening 224*a* at least have two different lengths, therefore, in hot plug, an electrical spark may be intended to only be generated at the contact portion 223*h* which has the shortest distance from the mating opening 224*a*, which can avoid the electrical spark affecting other contact portion 223*h* in hot plug, also, the plurality of contact portions 223 which has different distances from the mating opening 224*a* also may lower insertion force during mating. In addition, the contact portions 223*h* of the two side plates 223 can lower contact electric resistance between the first terminal 12 and the second terminal 22.

The contact portion 223*h* of the at least one elastic arm 223*e* is close to the mating opening 224*a* relative to contact portion 223*h* of the side frame bar 223*b*, the contact portion 223*h* of the at least one elastic arm 223*e* is formed to a tip of the at least one elastic arm 223*e*. Specifically, in the present embodiment, the at least one elastic arm 223*e* includes a first elastic arm 223*f* and a second elastic arm 223*g*, the first elastic arm 223*f* is positioned between the second elastic arm 223*g* and the side frame bar 223*b*, and the contact portion 223*h* of the first elastic arm 223*f* is closest to the mating opening 224*a*, that is to say, the distance between the contact portion 223*h* of the first elastic arm 223*f* and the mating opening 224*a*, the distance between the contact portion 223*h* of the second elastic arm 223*g* and the mating opening 224*a* and the distance between the contact portion 223*h* of the side frame bar 223*b* and the mating opening 224*a* all are not the same, so as to further lower the insertion force during mating. Also, during mating, because firstly the contact portion 223*h* of the first elastic arm 223*f* contacts the first terminal 12, then the contact portion 223*h* of the second elastic arm 223*g* contacts the first terminal 12, finally the contact portion 223*h* of the side frame bar 223*b* contacts the first terminal 12, therefore the contact portion 223*h* of the side frame bar 223*b* and the contact portion 223*h* of the second elastic arm 223*g* can be acted as primary contact points which is less suffered from affecting of the electrical spark, but the contact portion 223*h* of the first elastic arm 223*f* can be acted as secondary contact point. In a varied embodiment, only one of the elastic arms 223*e* may be close to the mating opening 224*a* relative to the contact portion 223*h* of the side frame bar 223*b*, for example, only the contact portion 223*h* of the first elastic arm 223*f* or the contact portion 223*h* of the second elastic arm 223*g* is close to the mating opening 224*a* relative to the contact portion 223*h* of the side frame bar 223*b*. In the present embodiment, the first elastic arm 223*f* and the second elastic arm 223*g* are connected to the frame body 223*a* and are encircled by the frame body 223*a*, but in a varied embodiment, one of the first elastic arm 223*f* and the second elastic arm 223*g* also may be formed outside the frame body 223*a*, that is, the one of the first elastic arm 223*f* and the second elastic arm 223*g* also may be not encircled by the frame body 223*a*, in such an implementing manner, the one of the first elastic arm 223*f* and the second elastic arm 223*g* which is not encircled by the frame body 223*a* also may be not connected to the frame body 223*a*, therefore the present disclosure should be not limited to the implementing manner of the present embodiment.

Figure 13:
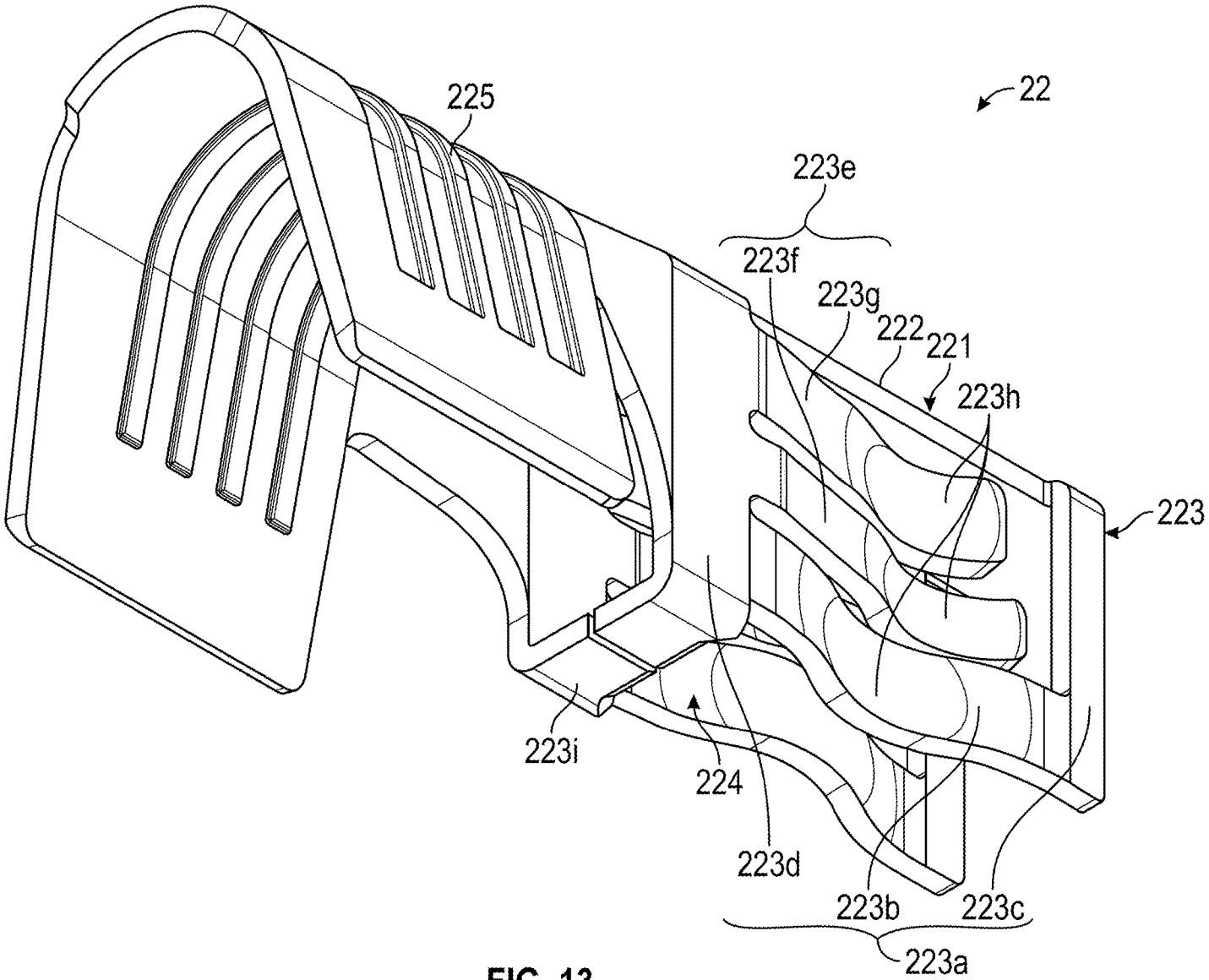
FIG. 13 is a perspective view viewed from another angle of FIG. 12.
Figure 14:
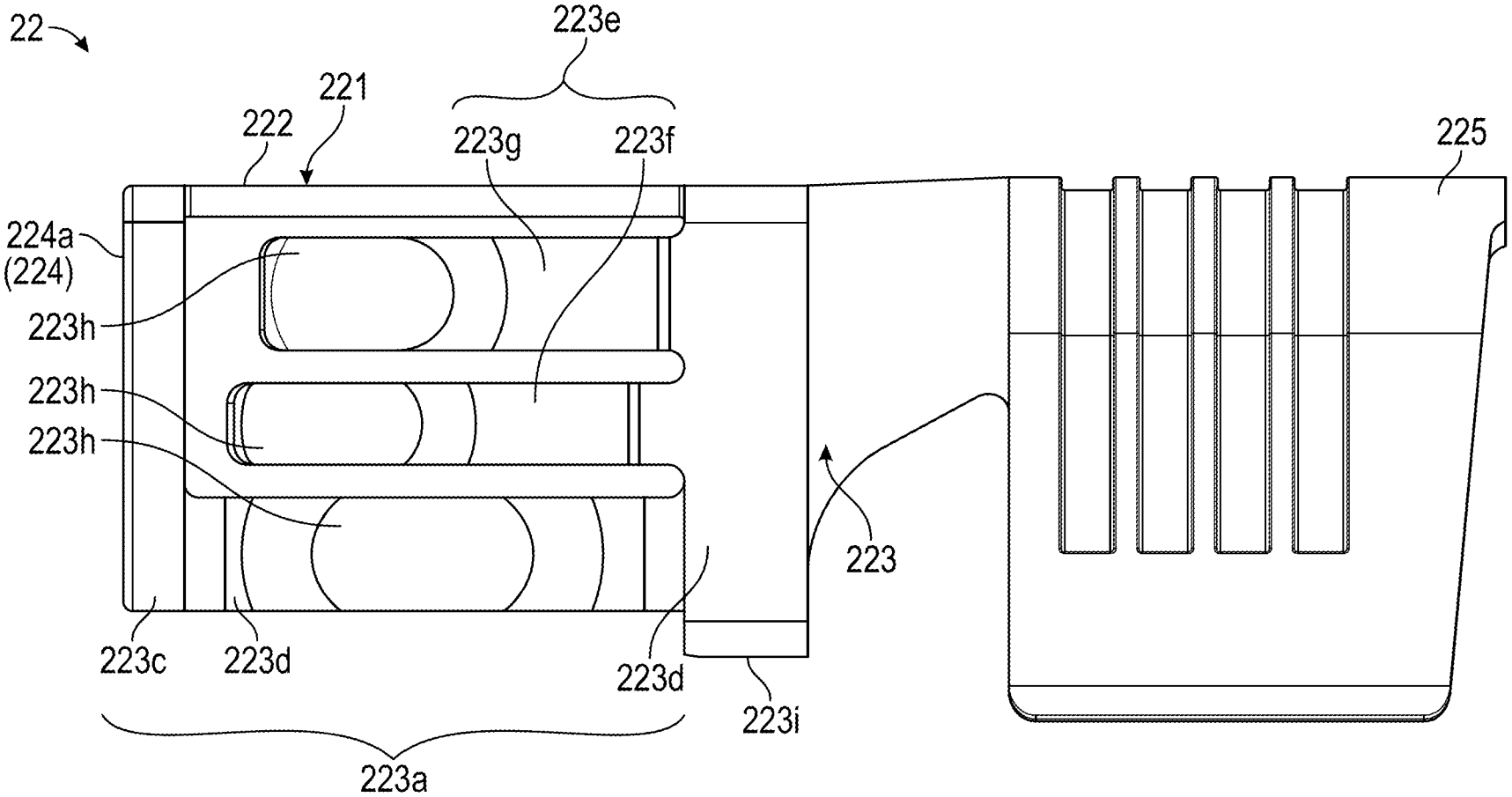
FIG. 14 is a side view of the second terminal of the second connector of the embodiment.
Figure 15:
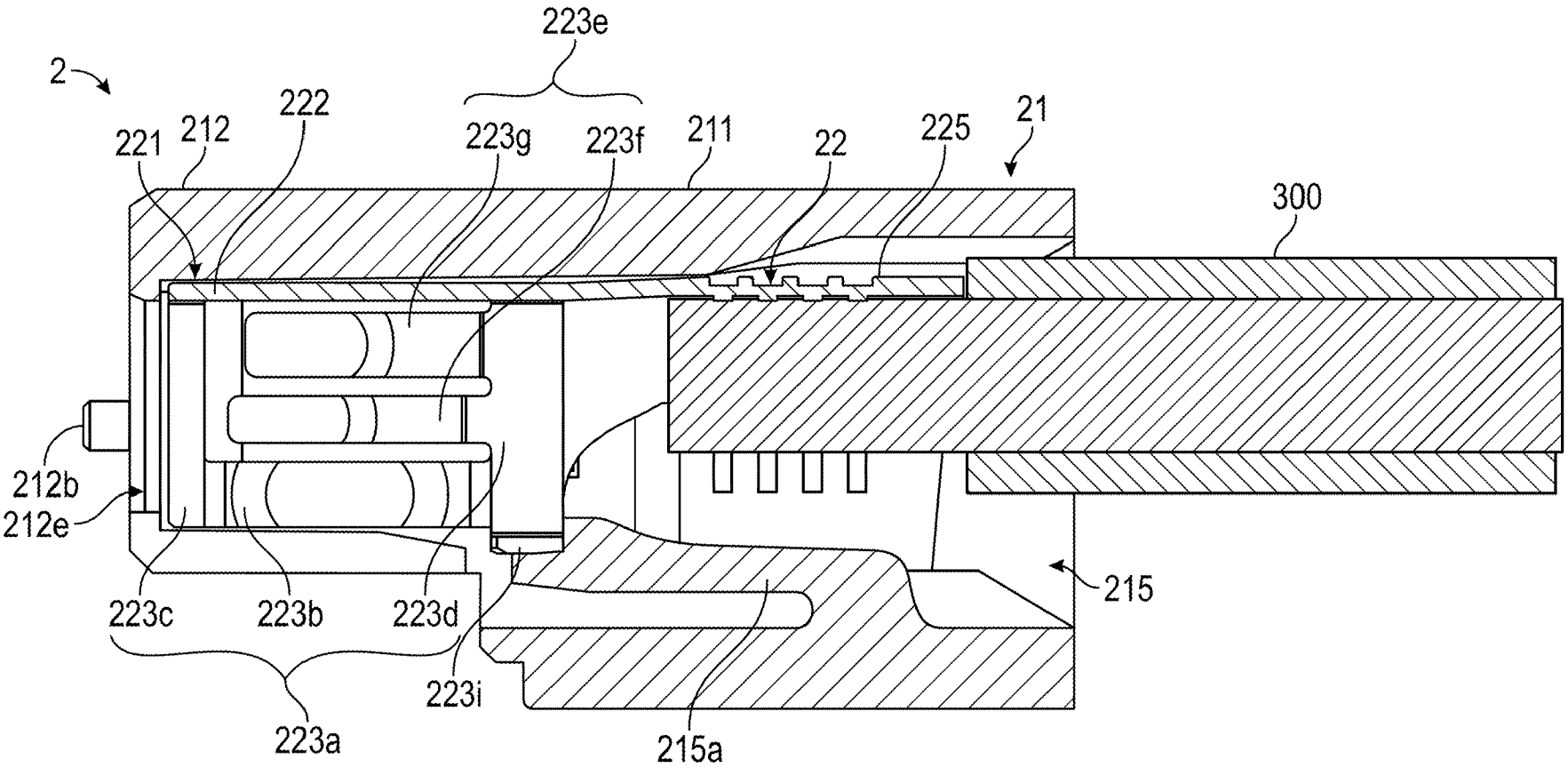
FIG. 15 is a cross sectional view of the second connector of the embodiment illustrating a cooperation relationship between a latching elastic arm of an insulative housing of the second connector and a stopping portion of the second terminal.
Figure 16:
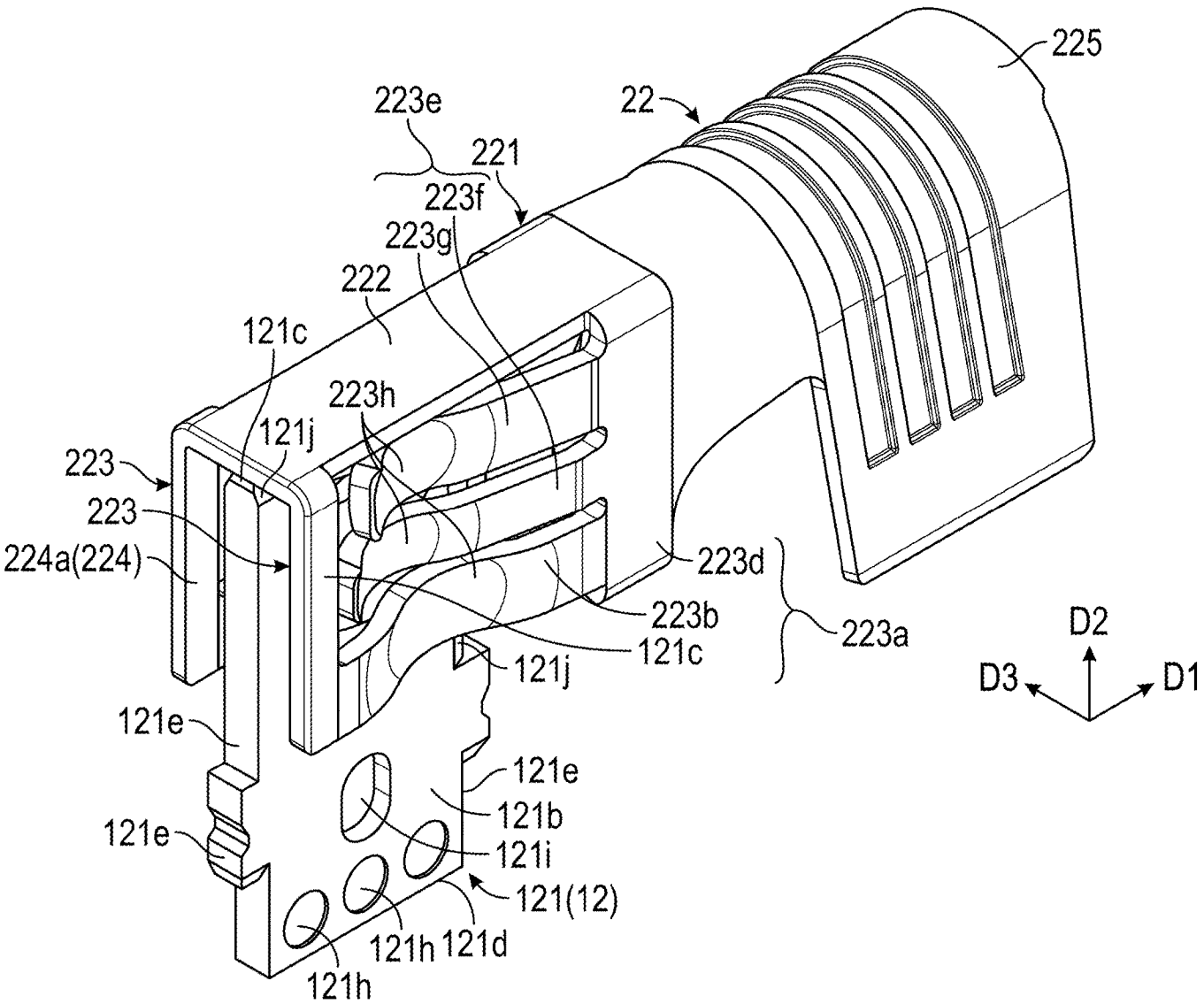
FIG. 16 is a perspective view of the first terminal and the second terminal of the embodiment illustrating a cooperation relationship between the first terminal and the second terminal when the first connector and the second connector of the embodiment are mated with each other in the front-rear direction.
Figure 17:
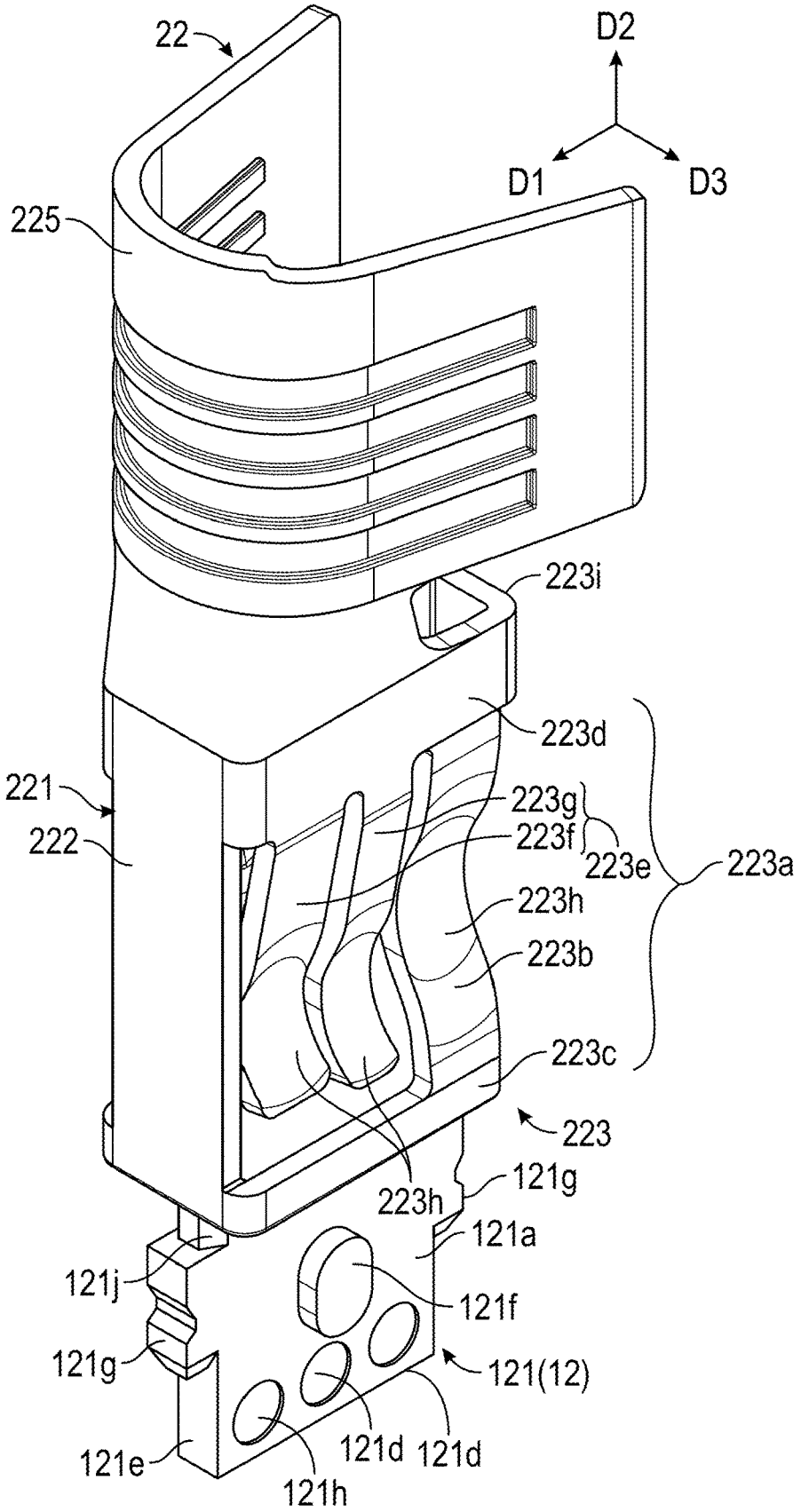
FIG. 17 is a perspective view of the first terminal and the second terminal of the embodiment illustrating a cooperation relationship between the first terminal and the second terminal when the first connector and the second connector of the embodiment are mated with each other in the up-down direction.

Referring to FIG. 13 and FIG. 15, in addition, in the present embodiment, a stopping portion 223*i* is formed between two end portions of the two rear frame bars 223*d* of the two side plates 223 away from the base plate 222, is spaced apart from the base plate 222 and faces the base plate 222. A latching elastic arm 215*a* is provided in the second receiving groove 215 of the insulative housing 21 of the second connector 2, when each second terminal 22 is inserted into the corresponding second receiving groove 215, the stopping portion 223*i* is latched to the latching elastic arm 215*a*, so that the second terminal 22 is held in the second receiving groove 215.

Referring to FIG. 1, FIG. 6, FIG. 16 and FIG. 17, moreover, the side edge 121*e* toward the first insertion opening 112 and the top edge 121*c* toward the second insertion opening 113 in the sheet body 121 of each first terminal 12 each are formed with a guiding edge portion 121*j*, with the guiding edge portions 121*j*, whether the second connector 2 is mated with the first connector 1 along the front-rear direction D1 or along the up-down direction D2, it can lower the insertion force between the second terminal 22 and the first terminal 12, thereby making the mating more smoothly.

In conclusion, in the electrical connection device 100 of the present disclosure, with the first insertion opening 112 and the second insertion opening 113 of the first connector 1 which are toward different directions respectively, the second connector 2 can be mated with the first connector 1 along different directions, and whether the second connector 2 is mated with the first connector 1 along the front-rear direction D1 or along the up-down direction D2, the stopping block 114 of the first connector 1 and the contacting surfaces 214 and the guiding grooves 212*a* of the second connector 2 provide a stopping and guiding function. In addition, with the first positioning structure 117*a* and the second positioning structure 115*a* of the first connector 1 and the second connector 2 of third positioning structure 212*b*, whether the second connector 2 is mated with the first connector 1 along the front-rear direction D1 or along the up-down direction D2, a positioning function can be provided. Moreover, with the locking protrusion 231 of the elastic locking bar 23 of the second connector 2 and the locking recess 116*a* of the first connector 1, when the second connector 2 is mated with the first connector 1 along the front-rear direction D1 and when the second connector 2 is mated with the first connector 1 along the up-down direction D2, a locking function is provided so as to prevent the second connector 2 and the first connector 1 being separated from each other. Also, because the two ends of the elastic locking bar 23 are integrally connected to the insulative housing 21, it may prevent the two elastic locking bars 23 and other cables to be entangled and dragged with each other. Secondarily, with a design of the protuberance 121*f* and the pits 121*h*, it provides better holding force and avoids solder wicking being too high when soldered at the same time. Finally, the frame bodies 223*a* of the two side plates 223 provide the contact portions 223*h* used to contact, increase the whole structure strength of the second terminal 22, and at the same time function as protecting the at least one elastic arm 223*e*. And distances between the plurality of contact portions 223*h* and the mating opening 224*a* at least have two different lengths, therefore, in hot plug, an electrical spark may be intended to only be generated at the contact portion 223*h* which has the shortest distance from the mating opening 224*a*, which can avoid the electrical spark affecting other contact portion 223*h* in hot plug, also, the plurality of contact portions 223 which has different distances from the mating opening 224*a* also may lower insertion force during mating.

However, what is described above is just the embodiments of the present disclosure, which is not intended to limit the scope implementing the present disclosure, any simple equivalent variations and modifications made according to the claims and the specification of the present disclosure will also be fallen within the scope of the present disclosure.

The invention claimed is:

1. An electrical connection device comprising:

a first connector comprising an insulative body and a plurality of first terminals provided to the insulative body, the insulative body having an insertion groove, a first insertion opening which is communicated with the insertion groove and toward a first direction, a second insertion opening which is communicated with the insertion groove and toward a second direction and a stopping block which is positioned between the first insertion opening and the second insertion opening, the stopping block having a first stopping face which faces the first direction and a second stopping face which faces the second direction; and a second connector comprising an insulative housing and a plurality of second terminals provided to the insulative housing, the insulative housing having a mating portion and a contacting surface, when the second connector is mated with the first connector along the first direction, the mating portion being inserted into the insertion groove from the first insertion opening, and the contacting surface being stopped by the first stopping face of the stopping block, when the second connector is mated with the first connector along the second direction, the mating portion being inserted into the insertion groove from the second insertion opening, and the contacting surface being stopped by the second stopping face of the stopping block, wherein the insulative housing further has a body portion, the mating portion extends forwardly from the body portion, and a shoulder is formed between the mating portion and the body portion, the shoulder forms the contacting surface which is toward the front, and wherein a guiding groove is formed on the mating portion and connected to the shoulder, the contacting surface is positioned at a rear end of the guiding groove, when the second connector is mated with the first connector along the first direction and when the second connector is mated with the first connector along the second direction, the stopping block is slidably received in the guiding groove.

2. The electrical connection device as defined in claim 1, wherein the insulative body has a bottom wall, two side walls and a rear wall, the bottom wall, the two side walls and the rear wall together define the insertion groove.

3. The electrical connection device as defined in claim 1, wherein the insulative body has two side walls, the first insertion opening is defined by the first stopping face and front end faces of the two side walls, the second insertion opening is defined by the second stopping face and top faces of the two side walls.

4. The electrical connection device as defined in claim 1, wherein the plurality of first terminals are sheet-shaped terminals which each extend along the first direction and the second direction, a part toward the first insertion opening and a part toward the second insertion opening of each first terminal each are formed with a guiding edge portion, the plurality of second terminals are clipping terminals which are used to clip the plurality of first terminals respectively.

5. The electrical connection device as defined in claim 1, wherein the insulative body is formed with a first fool-proof structure which extends along the first direction and a second fool-proof structure which extends along the second direction, the mating portion of the insulative housing is formed with a third fool-proof structure which corresponds to the first fool-proof structure and a fourth fool-proof structure which corresponds to the second fool-proof structure, when the second connector is mated with the first connector along the first direction, the first fool-proof structure and the third fool-proof structure correspondingly cooperate with each other in concave-convex fit, when the second connector is mated with the first connector along the second direction, the second fool-proof structure and the fourth fool-proof structure correspondingly cooperate with each other in concave-convex fit.

6. The electrical connection device as defined in claim 5, wherein the first fool-proof structure is a protruding key, the second fool-proof structure is a guiding slot, the third fool-proof structure is a key groove, the fourth fool-proof structure is a protruding rail.

7. An electrical connection device comprising:

a first connector comprising an insulative body and a plurality of first terminals provided to the insulative body, the insulative body having an insertion groove, a first insertion opening which is communicated with the insertion groove and toward a first direction, a second insertion opening which is communicated with the insertion groove and toward a second direction and a first positioning structure and a second positioning structure which are formed to an inner wall surface of the insertion groove; and a second connector comprising an insulative housing and a plurality of second terminals provided to the insulative housing, the insulative housing having a mating portion and a third positioning structure formed to the mating portion, when the second connector is mated with the first connector along the first direction, the mating portion being inserted into the insertion groove from the first insertion opening, and the third positioning structure and the first positioning structure correspondingly cooperating with each other in concave-convex fit, when the second connector is mated with the first connector along the second direction, the mating portion being inserted into the insertion groove from the second insertion opening, and the third positioning structure and the second positioning structure correspondingly cooperating with each other in concave-convex fit, wherein the insulative body has a bottom wall, two side walls and a rear wall, the bottom wall, the two side walls and the rear wall together define the insertion groove, the first positioning structure is formed to the rear wall, the second positioning structure is formed to the bottom wall, the third positioning structure is formed to a front end of the mating portion of the insulative housing.

8. The electrical connection device as defined in claim 7, wherein the first positioning structure and the second positioning structure are positioning recesses, the third positioning structure is a positioning protrusion.

9. The electrical connection device as defined in claim 7, wherein the plurality of first terminals are sheet-shaped terminals which each extend along the first direction and the second direction, a part toward the first insertion opening and a part toward the second insertion opening of each first terminal each are formed with a guiding edge portion, the plurality of second terminals are clipping terminals which are used to clip the plurality of first terminals respectively.

10. The electrical connection device as defined in claim 7, wherein the insulative body is formed with a first fool-proof structure which extends along the first direction and a second fool-proof structure which extends along the second direction, the mating portion of the insulative housing is formed with a third fool-proof structure which corresponds to the first fool-proof structure and a fourth fool-proof structure which corresponds to the second fool-proof structure, when the second connector is mated with the first connector along the first direction, the first fool-proof structure and the third fool-proof structure correspondingly cooperate with each other in concave-convex fit, when the second connector is mated with the first connector along the second direction, the second fool-proof structure and the fourth fool-proof structure correspondingly cooperate with each other in concave-convex fit.

11. The electrical connection device as defined in claim 10, wherein the first fool-proof structure is a protruding key, the second fool-proof structure is a guiding slot, the third fool-proof structure is a key groove, the fourth fool-proof structure is a protruding rail.

* * * * *